US009934750B2

(12) United States Patent
Park et al.

(10) Patent No.: US 9,934,750 B2
(45) Date of Patent: Apr. 3, 2018

(54) DATA DRIVER, DISPLAY APPARATUS HAVING THE SAME AND METHOD OF DRIVING DISPLAY PANEL USING THE SAME

(71) Applicant: SAMSUNG DISPLAY CO., LTD., Yongin, Gyeonggi-Do (KR)

(72) Inventors: Su-Hyeong Park, Gyeongju-si (KR); Ho-Yong Jung, Seongam-si (KR); Sang-Mi Kim, Yongin-si (KR); Ji-Myoung Seo, Suwon-si (KR); Kyoung-Won Lee, Seoul (KR); Hee-Soon Jeong, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 295 days.

(21) Appl. No.: 14/622,696

(22) Filed: Feb. 13, 2015

(65) Prior Publication Data

US 2015/0243204 A1 Aug. 27, 2015

(30) Foreign Application Priority Data

Feb. 24, 2014 (KR) ..... 10-2014-0021175

(51) Int. Cl.

| | |
|---|---|
| ***G09G 3/20*** | (2006.01) |
| ***G09G 3/36*** | (2006.01) |
| ***G09G 5/00*** | (2006.01) |

(52) U.S. Cl.

CPC ..... *G09G 3/3688* (2013.01); *G09G 2310/027* (2013.01); *G09G 2310/0248* (2013.01); *G09G 2310/0291* (2013.01); *G09G 2310/08* (2013.01); *G09G 2320/10* (2013.01); *G09G 2330/021* (2013.01)

(58) Field of Classification Search

CPC .. G09G 3/20; G09G 3/36; G09G 5/00; G09G 2310/0248; G09G 2310/027; G09G 2310/0291; G09G 2310/08; G09G 2320/10; G09G 2330/021; G09G 3/3688

See application file for complete search history.

(56) References Cited

U.S. PATENT DOCUMENTS

| | | | |
|---|---|---|---|
| 5,977,940 | A | 11/1999 | Akiyama et al. |
| 6,727,880 | B2 | 4/2004 | Lee |
| 6,747,626 | B2 | 6/2004 | Chiang |
| 7,151,549 | B2 | 12/2006 | Kudo et al. |

(Continued)

FOREIGN PATENT DOCUMENTS

| | | |
|---|---|---|
| KR | 10-0934975 B1 | 1/2010 |
| KR | 10-2010-0044932 A | 5/2010 |
| KR | 10-1342110 B1 | 12/2013 |

*Primary Examiner* — Temesghen Ghebretinsae
*Assistant Examiner* — Paras D Karki
(74) *Attorney, Agent, or Firm* — Lewis Roca Rothgerber Christie LLP

(57) ABSTRACT

A data driver including a power control part configured to control power according to mode signal determined based on an input image, a digital to analog converting part configured to convert a digital data signal into an analog data voltage, a buffering part configured to buffer the data voltage, a first switching part configured to apply the data voltage to a data line in a normal mode, when turned on, and a second switching part configured to apply a blank voltage to the data line in a blank period of a low frequency mode, when turned on.

15 Claims, 16 Drawing Sheets

(56) References Cited

U.S. PATENT DOCUMENTS

| | | | | |
|---|---|---|---|---|
| 7,432,904 | B2 | 10/2008 | Kang | |
| 7,616,182 | B2 | 11/2009 | Iwabuchi | |
| 2001/0009419 | A1* | 7/2001 | Ikeno et al. | H04N 19/46 345/555 |
| 2002/0063674 | A1* | 5/2002 | Chiang | G09G 3/2011 345/98 |
| 2002/0145602 | A1* | 10/2002 | Matsueda | G09G 3/2011 345/213 |
| 2003/0169247 | A1* | 9/2003 | Kawabe | G09G 3/342 345/204 |
| 2005/0093722 | A1* | 5/2005 | Smith | H03M 1/1028 341/118 |
| 2010/0097369 | A1* | 4/2010 | Fujita | G09G 3/3614 345/213 |
| 2012/0299903 | A1 | 11/2012 | Lim et al. | |
| 2013/0038621 | A1 | 2/2013 | Choi et al. | |
| 2013/0113811 | A1 | 5/2013 | Choi et al. | |
| 2014/0160182 | A1 | 6/2014 | Hong et al. | |
| 2014/0253212 | A1* | 9/2014 | Steedman | H03K 3/356104 327/333 |

* cited by examiner

DATA DRIVER, DISPLAY APPARATUS HAVING THE SAME AND METHOD OF DRIVING DISPLAY PANEL USING THE SAME

CROSS-REFERENCE TO RELATED APPLICATION

This application claims priority to, and the benefit of, Korean Patent Application No. 10-2014-0021175, filed on Feb. 24, 2014 in the Korean Intellectual Property Office KIPO, the content of which is herein incorporated by reference in its entirety.

BACKGROUND

1. Field

Aspects of embodiments of the present invention relate to a data driver, a display apparatus including the data driver and a method of driving a display panel by utilizing the data driver. More particularly, aspects of embodiments of the present invention relate to a data driver for improving a display quality, a display apparatus including the data driver and a method of driving a display panel by utilizing the data driver.

2. Description of the Related Art

Methods to reduce (e.g., minimize) a power consumption of an information technology (IT) product, such as a desktop computer and a mobile computer device, have been studied.

To improve the IT product, which includes a display panel, a power consumption of the display panel may be reduced (e.g., minimized). When the display panel displays a static image, the display panel may be driven at a relatively low frequency so that a power consumption of the display panel may be reduced.

When the display panel is driven at a relatively low frequency, switching elements of the display panel are turned off during a blank period (e.g., a blank duration) so that a pixel current may be leaked through the switching elements that are turned off. Thus, a display quality may decrease.

SUMMARY

Aspects of the embodiments of the present invention are directed toward a data driver capable of reducing power consumption and improving display quality.

Aspects of the embodiments of the present invention are further directed toward a display apparatus including the data driver.

Aspects of the embodiments of the present invention are further directed toward a method of driving a display apparatus by utilizing (e.g., using) the data driver.

According to some embodiments of the present invention, there is provided a data driver including: a power control part configured to control power according to mode signal determined based on an input image; a digital to analog converting part configured to convert a digital data signal into an analog data voltage; a buffering part configured to buffer the data voltage; a first switching part configured to apply the data voltage to a data line in a normal mode, when turned on; and a second switching part configured to apply a blank voltage to the data line in a blank period of a low frequency mode, when turned on.

In one embodiment, the data driver further includes a power switching part configured to turn off the digital to analog converting part and the buffering part in the blank period of a low frequency mode.

In one embodiment, wherein the power switching part is configured to receive a first power voltage that is a substantially constant voltage, and a second power voltage that is a variable voltage.

In one embodiment, further including a blank voltage providing part configured to provide the blank voltage to the second switching part.

In one embodiment, the blank voltage is determined by one of an external blank voltage applied from out of the data driver and an internal blank voltage generated in the power control part.

In one embodiment, the blank voltage providing part includes: a blank digital to analog converter coupled to the power control part; a blank buffer coupled to the blank digital to analog converter; and a blank multiplexer coupled to an external line and the blank buffer, and configured to selectively output the external blank voltage or the internal blank voltage.

In one embodiment, the blank voltage is determined by an internal blank voltage generated in the power control part.

In one embodiment, the blank voltage providing part includes: a blank digital to analog converter coupled to the power control part; and a blank buffer coupled to the blank digital to analog converter.

In one embodiment, the blank voltage is determined by an external blank voltage applied from outside of the data driver.

In one embodiment, the blank voltage is determined by utilizing an average pixel voltage of pixels of a display panel corresponding to the input image.

In one embodiment, the second switching part includes: switches in a first row configured to be alternately turned on to apply a first blank voltage to the data line; and switches in a second row configured to be alternately turned on to apply a second blank voltage to the data line.

In one embodiment, the first blank voltage has a polarity opposite to that of the second blank voltage.

In one embodiment, the second switching part includes switches in a first row coupled to odd-numbered data lines and switches in a second row coupled to even-numbered data lines.

In one embodiment, the data driver further includes a blank path selector configured to alternately transmit a first blank voltage and a second blank voltage to the switches in the first row and to alternately transmit the second blank voltage and the first blank voltage to the switches in the second row.

According to some embodiments of the present invention, there is provided a display apparatus including: a display panel configured to display an image based on an input image; a timing controller configured to generate a frame rate of the display panel and a mode signal based on the input image; and a data driver including: a power control part configured to control power according to the mode signal; a digital to analog converting part configured to convert a digital data signal into an analog data voltage; a buffering part configured to buffer the data voltage; a first switching part configured to apply the data voltage to a data line in a normal mode, when turned on; and a second switching part configured to apply a blank voltage to the data line in a blank period of a low frequency mode, when turned on.

In one embodiment, the data driver further includes a power switching part configured to turn off the digital to analog converting part and the buffering part in the blank period of a low frequency mode.

In one embodiment, the blank voltage is determined by utilizing an average pixel voltage of pixels of a display panel corresponding to the input image.

According to some embodiments of the present invention, there is provided a method of driving a display panel, the method including: determining a frame rate and a mode signal based on an input image; converting a digital data signal into an analog data voltage; applying the data voltage to a data line in a normal mode; and applying a blank voltage to the data line in a blank period of a low frequency mode.

In one embodiment, a digital to analog converting part is configured to convert the digital data signal into the analog data voltage and a buffering part configured to buffer the data voltage are turned off in the blank period of the low frequency mode.

In one embodiment, the blank voltage is determined by utilizing an average pixel voltage of pixels of a display panel corresponding to the input image.

Accordingly, in some embodiments of the present invention, the frame rate is adjusted according to an image displayed on the display panel so that a power consumption of the display apparatus may be reduced. In addition, a blank voltage is outputted to the display panel during a blank period (e.g., a blank duration) so that a leakage of the pixel current may be reduced (e.g., minimized). Thus, a display quality of the display panel may be improved (e.g., increased).

BRIEF DESCRIPTION OF THE DRAWINGS

The above and other features and aspects of the present invention will become more apparent by describing in detailed example embodiments thereof with reference to the accompanying drawings, in which.

DETAILED DESCRIPTION INVENTION

Hereinafter, the present invention will be explained in detail with reference to the accompanying drawings.

Figure 1:
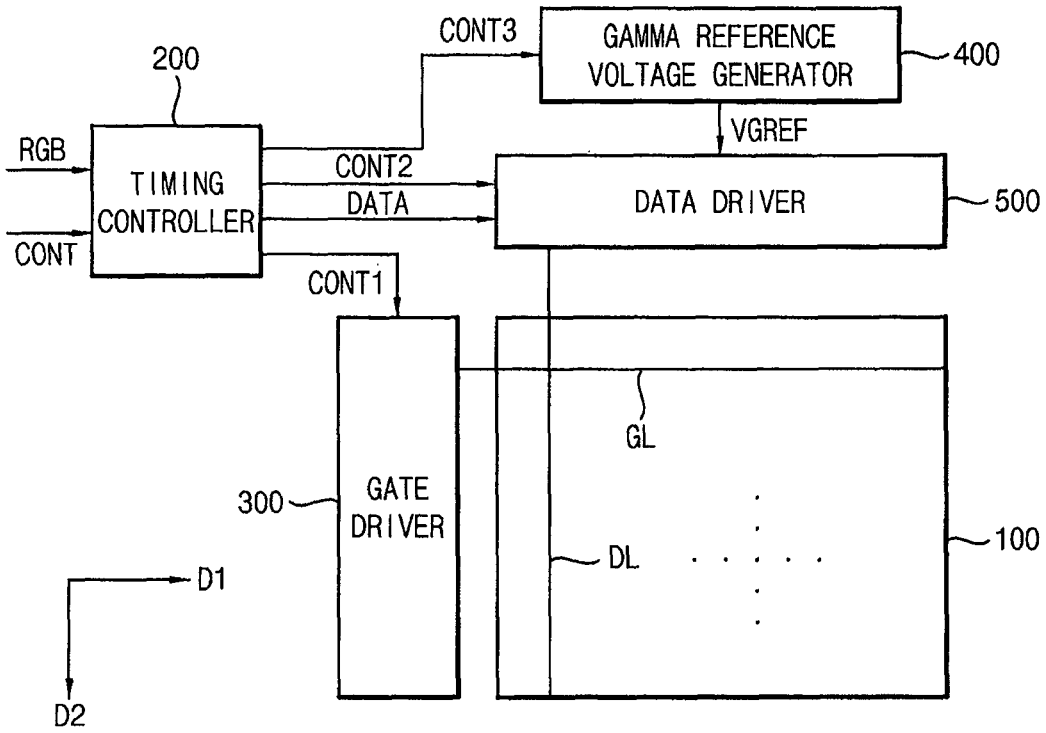
FIG. 1 is a block diagram illustrating a display apparatus, according to an example embodiment of the present invention.

FIG. 1 is a block diagram illustrating a display apparatus, according to an example embodiment of the present invention.

Referring to FIG. 1, the display apparatus includes a display panel 100 and a panel driver. The panel driver includes a timing controller 200, a gate driver 300, a gamma reference voltage generator 400, and a data driver 500.

The display panel 100 has a display region on which an image is displayed and a peripheral region adjacent to the display region.

The display panel 100 includes a plurality of gate lines GL, a plurality of data lines DL and a plurality of pixels coupled to the gate lines GL and the data lines DL. The gate lines GL extend in a first direction D1 and the data lines DL extend in a second direction D2 crossing the first direction D1.

Each pixel includes a switching element, a liquid crystal capacitor and a storage capacitor. The liquid crystal capacitor and the storage capacitor are electrically coupled to the switching element. The pixels may be arranged (e.g., disposed) in a matrix form.

The timing controller 200 receives input image data RGB and an input control signal CONT from an external apparatus. The input image data may include red image data R, green image data G, and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 may adjust a frame rate FR of the display panel 100 based on the input image data RGB. The timing controller 200 may generate a mode signal MODE based on the input image data RGB. The mode signal MODE may include a normal mode and a low frequency mode.

The timing controller 200 may output the frame rate FR and the mode signal MODE to the data driver 500.

In the normal mode, the display panel 100 may be driven at a first frame rate. For example, the first frame rate may be substantially the same as an input frequency of the input image data RGB. For example, the first frame rate may be about 60 Hz.

In the low frequency mode, the display panel 100 may be driven at a second frame rate. For example, the second frame rate may be less than the first frame rate. For example, the second frame rate may be about 20 Hz. The second frame rate may vary according to the input image data RGB.

In the low frequency mode, the display panel 100 is driven at the second frame rate, which is less than the first frame rate so that the low frequency mode may include a blank period (e.g., a blank duration) when the data signal DATA is not outputted. For example, the low frequency mode may include a normal output period (e.g., a normal output duration) when the data signal DATA is normally outputted and the blank period when the data signal DATA is not outputted. For example, when the frame rate of the normal mode is about 60 Hz and the frame rate of the low frequency mode is about 20 Hz, the data signal DATA may be normally outputted during ⅓ of the low frequency mode period (also referred to as the normal output period) and the data signal DATA may not be outputted during the remaining ⅔ of the low frequency mode (also referred to as the blank duration).

During the blank period, the timing controller 200 may not output the first control signal CONT1 to the gate driver 300. For example, during the blank period, the timing controller 200 may not output the vertical start signal to the gate driver 300.

In addition, during the blank period, the timing controller 200 may not output the second control signal CONT2 and the data signal DATA to the data driver 500. For example, during the blank period, the timing controller 200 may not output the horizontal start signal and the load signal to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

A structure and an operation of the timing controller 200 are described with reference to FIG. 2 in more detail.

The gate driver 300 generates gate signals driving the gate lines GL in response to the first control signal CONT1 received from the timing controller 200. The gate driver 300 sequentially outputs the gate signals to the gate lines GL.

The gate driver 300 may be directly mounted on the display panel 100, or may be coupled to the display panel 100 via a tape carrier package (TCP). Alternatively, the gate driver 300 may be integrated on the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be located in the data driver 500. Alternatively, the gamma reference voltage generator 400 may be located in the timing controller 200.

The data driver 500 receives the second control signal CONT2 and the data signal DATA from the timing controller 200, and receives the gamma reference voltages VGREF from the gamma reference voltage generator 400. The data driver 500 converts the data signal DATA into analog data voltages (e.g., continuous time-varying data voltages) by utilizing (e.g., using) the gamma reference voltages VGREF. The data driver 500 outputs the data voltages to the data lines DL.

The data driver 500 outputs the data voltages to the data lines DL in the normal mode. The data driver 500 outputs the blank voltage to the data lines DL during the blank period (e.g., the blank duration) in the low frequency mode.

The data driver 500 may be directly mounted on the display panel 100, or be coupled to the display panel 100 via a TCP. Alternatively, the data driver 500 may be integrated on the display panel 100.

A structure and an operation of the data driver 500 are described with reference to FIGS. 3, 4A and 4B in more detail.

Figure 2:
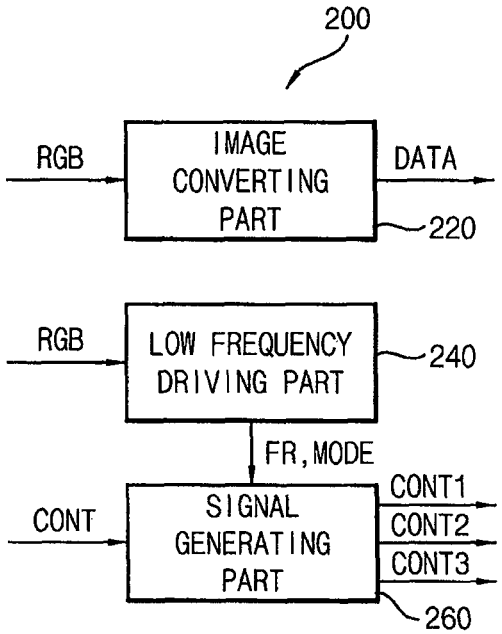
FIG. 2 is a block diagram illustrating a timing controller of FIG. 1, according to an example embodiment of the present invention.

FIG. 2 is a block diagram illustrating the timing controller 200 of FIG. 1, according to an embodiment of the present invention.

Referring to FIGS. 1 and 2, the timing controller 200 includes an image converting part 220, a low frequency driving part 240, and a signal generating part 260.

The image converting part 220 compensates grayscale data of the input image data RGB and rearranges the input image data RGB to generate the data signal DATA to correspond to a data type (e.g., the kind of data) of the data driver 500. The data signal DATA may be a digital type, i.e., a digital signal (e.g., a quantified, discrete-time signal having, for example, two voltage values). The image converting part 220 outputs the data signal DATA to the data driver 500.

For example, the image converting part 220 may include an adaptive color correcting part and a dynamic capacitance compensating part.

The adaptive color correcting part receives the grayscale data of the input image data RGB, and operates an adaptive color correction ("ACC"). The adaptive color correcting part may compensate the grayscale data by utilizing (e.g., using) a gamma curve.

The dynamic capacitance compensating part operates a dynamic capacitance compensation ("DCC"), which compensates the grayscale data of the present frame data by utilizing (e.g., using) previous frame data and the present frame data.

The low frequency driving part 240 receives the input image data RGB. The low frequency driving part 240 determines and generates a frame rate FR of the display panel 100 and a mode signal MODE based on the input image data RGB. The low frequency driving part 240 may output the frame rate FR and the mode signal MODE to the signal generating part 260.

The signal generating part 260 receives the input control signal CONT. The signal generating part 260 generates the first control signal CONT1 to control a driving timing of the gate driver 300 based on the input control signal CONT, the frame rate FR and the mode signal MODE. The signal generating part 260 generates the second control signal CONT2 to control a driving timing of the data driver 500 based on the input control signal CONT and the frame rate FR. The signal generating part 260 generates the third control signal CONT3 to control a driving timing of the gamma reference voltage generator 400 based on the input control signal CONT, the frame rate FR and the mode signal MODE.

The signal generating part 260 outputs the first control signal CONT1 to the gate driver 300. The signal generating part 260 outputs the second control signal CONT2 to the data driver 500. The signal generating part 260 outputs the third control signal CONT3 to the gamma reference voltage generator 400. In an example embodiment, the second control signal CONT2 may include the frame rate FR and the mode signal MODE.

Figure 3:
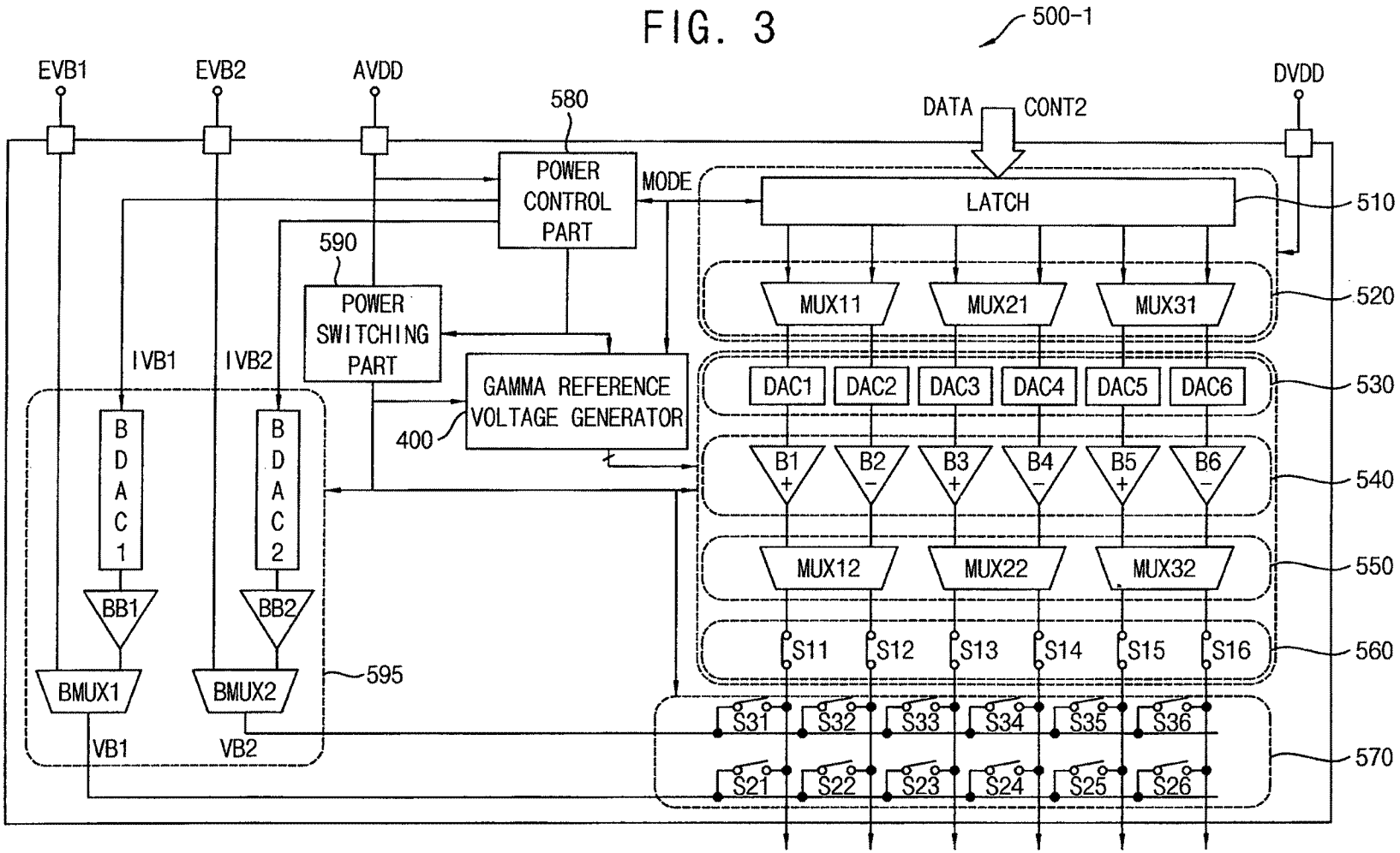
FIG. 3 is a block diagram illustrating a data driver of FIG. 1, according to an example embodiment of the present invention.

FIG. 3 is a block diagram illustrating the data driver 500-1 (which is an example of the data driver 500 of FIG. 1), according to an example embodiment of the present invention. FIG. 4A is a block diagram illustrating the data driver 500-1 of FIG. 3 in the normal mode, according to an example embodiment of the present invention. FIG. 4B is a block diagram illustrating the data driver 500-1 of FIG. 3 during the blank period in the low frequency mode, according to an example embodiment of the present invention.

Referring to FIGS. 1 to 4B, the data driver 500/500-1 includes a latch part 510, a first multiplexing part 520, a digital to analog converting part 530, a buffer part 540, a second multiplexing part 550, a first switching part 560, a second switching part 570, a power control part 580, a power switching part 590, and a blank voltage providing part 595.

The latch part 510 receives the data signal DATA. The latch part 510 temporally stores the data signal DATA and outputs the data signal DATA to the digital to analog converting part 530 through the first multiplexing part 520. A digital power voltage DVDD may be applied to the latch part 510 and the first multiplexing part 520.

The digital to analog converting part 530 generates the analog data voltage based on the data signal DATA, which is a digital signal, and the gamma reference voltage VGREF. The digital to analog converting part 530 outputs the data voltage to the buffer part 540.

The digital to analog converting part 530 may include a plurality of digital to analog converters DAC1 to DAC6. Although six digital to analog converters are shown in FIGS. 3, 4A and 4B for convenience of explanation, the present invention is not limited to the shown number of the digital to analog converters. For example, the digital to analog converting part 530 may include the digital to analog converters corresponding to the number of the data lines DL.

The buffer part 540 buffers the data voltage. The buffering part 540 compensates the data voltage to have a uniform level. The buffering part 540 outputs the compensated data voltage to the data line DL through the second multiplexing part 550, the first switching part 560, and the second switching part 570.

The buffer part 540 may include a plurality of buffers B1 to B6. For example, first, third, and fifth buffers B1, B3, and B5 may buffer data voltage having a first polarity. Second, fourth, and sixth buffers B2, B4, and B6 may buffer data voltage having a second polarity, which is opposite to the first polarity.

The first multiplexing part 520 and the second multiplexing part 550 operate as path selectors. For example, when the data voltages having the first polarity are outputted to odd-numbered data lines and the data voltages having the second polarity are outputted to even-numbered data lines during a first frame, a first multiplexer MUX11 of the first multiplexing part 520 and a second multiplexer MUX12 of the second multiplexing part 550 transmit a first data voltage of the first polarity to the first data line through the first digital to analog converter DAC1 and the first buffer B1 and transmit a second data voltage of the second polarity to the second data line through the second digital to analog converter DAC2 and the second buffer B2.

In one embodiment, when the data voltages having the second polarity are outputted to odd-numbered data lines and the data voltages having the first polarity are outputted to even-numbered data lines during a second frame, the first multiplexer MUX11 of the first multiplexing part 520 and the second multiplexer MUX12 of the second multiplexing part 550 transmit a second data voltage of the first polarity to the second data line through the first digital to analog converter DAC1 and the first buffer B1 and transmit a first data voltage of the second polarity to the first data line through the second digital to analog converter DAC2 and the second buffer B2.

In the normal mode, the first switching part 560 is turned on to apply the data voltage to the data line DL. In the normal output period (e.g., the normal output duration) of the low frequency mode, the first switching part 560 is turned on to apply the data voltage to the data line DL. In one embodiment, in the blank period of the low frequency mode, the first switching part 560 is turned off to decouple the buffer part 540 from the data line DL.

The first switching part 560 includes a plurality of switches S11 to S16. When the switches S11 to S16 of the first switching part 560 are turned on, the buffer part 540 are coupled to the data line DL. When the switches S11 to S16 of the first switching part 560 are turned off, the buffer part 540 are decoupled from the data line DL.

The second multiplexing part 550 may be integrally formed with the first switching part 560 so that the multiplexing operation of the second multiplexing part 550 and the switching operation of the first switching part 560 may be concurrently (e.g., simultaneously) operated.

In the blank period of the low frequency mode, the second switching part 570 is turned on to apply a blank voltage to the data line DL. In one embodiment, in the normal mode, the second switching part 570 is turned off not to apply the blank voltage to the data line DL. In addition, in the normal output period (e.g., normal output duration) of the low frequency mode, the second switching part 570 is turned off not to apply the blank voltage to the data line DL.

The second switching part 570 includes a plurality of switches S21 to S26 in a first row and a plurality of switches S31 to S36 in a second row. In the blank period of the low frequency mode, the switches S21 to S26 in the first row may be alternately turned on. In the blank period of the low frequency mode, the switches S31 to S36 in the second row may be alternately turned on. In addition, in the blank period of the low frequency mode, the switch S21 and the switch S31, which are coupled to the first data line, may be alternately turned on. For example, in the blank period of the low frequency mode, one of the switch S21 and the switch S31 may be turned on and the other may be turned off.

During a first frame, the switches S21 to S26 in the first row may apply a first blank voltage VB1 to the odd-numbered data lines and the switches S31 to S36 in the second row may apply a second blank voltage VB2 to the even-numbered data lines. For example, during the first frame, the first, third, and fifth switches S21, S23, and S25 in the first row may be turned on to apply the first blank voltage VB1 to the odd-numbered data lines and the second, fourth, and sixth switches S32, S34, and S36 in the second row may be turned on to apply the second blank voltage VB2 to the even-numbered data lines.

The first blank voltage VB1 may have a polarity opposite to a polarity of the second blank voltage VB2. For example, the first blank voltage VB1 may have a positive polarity and the second blank voltage VB2 may have a negative polarity.

During a second frame when polarities of the data voltages are inverted with respect to polarities of the data voltages in the first frame, the switches S21 to S26 in the first row may apply the first blank voltage VB1 to the even-numbered data lines and the switches S31 to S36 in the second row may apply the second blank voltage VB2 to the odd-numbered data lines. For example, during the second frame, the second, fourth, and sixth switches S22, S24, and S26 in the first row may be turned on to apply the first blank voltage VB1 to the even-numbered data lines and the first, third, and fifth switches S31, S33, and S35 in the second row may be turned on to apply the second blank voltage VB2 to the odd-numbered data lines.

The power control part 580 controls power of the data driver 500-1 according to the mode signal MODE, which is determined according to the input image. In the normal mode, the power control part 580 may turn on (e.g., activate or enable) the first switching part 560 and may turn off (e.g., de-activate or disable) the second switching part 570. In the black period (e.g., the blank duration) of the low frequency mode, the power control part 580 may turn off the first switching part 560 and may turn on the second switching part 570.

The power control part 580 may control an operation of the power switching part according to the mode signal MODE. In addition, the power control part 580 may control an operation of the gamma reference voltage generator 400.

The power switching part 590 turns on or off elements in the data driver 500-1 according to control of the power control part 580.

In the blank period of the low frequency mode, the power switching part 590 may turn off the digital to analog converting part 530 and the buffer part 540. For example, in the blank period of the low frequency mode, the power switching part 590 may not provide a power voltage to the digital to analog converting part 530 and the buffer part 540. In the blank period of the low frequency mode, the power switching part 590 may turn off the gamma reference voltage generator 400, the first multiplexing part 520, and the second multiplexing part 550. For example, in the blank period of the low frequency mode, the power switching part 590 may not provide a power voltage to the gamma reference voltage generator 400, the first multiplexing part 520, and the second multiplexing part 550.

In the normal mode and in the normal output period of the low frequency mode, the power switching part 590 may turn off the blank voltage providing part 595.

In the present example embodiment, a first analog power voltage AVDD is applied to the power switching part 590. The first analog power voltage AVDD may be a constant voltage. In the present example embodiment, a blank power control operation is operated in the data driver 500-1.

The blank voltage providing part 595 provides the blank voltages VB1 and VB2 to the second switching part 570. In the blank period of the low frequency mode, the blank voltages VB1 and VB2 are applied to the data line DL through the second switching part 570.

In the present example embodiment, the blank voltage VB1 and VB2 may be determined by one of an external blank voltage EVB1 and EVB2 applied from outside and internal blank voltage IVB1 and IVB2 generated in the power control part 580.

The blank voltage VB1 and VB2 may be determined by utilizing (e.g., using) an average pixel voltage of pixels of the display panel 100 corresponding to the input image. For example, the external blank voltage EVB1 and EVB2 may not vary in real time. The external blank voltage EVB1 and EVB2 may be determined (e.g., predetermined) by an average pixel voltage of the pixels of the display panel corresponding to a normal image. For example, the internal blank voltage IVB1 and IVB2 may vary in real time. The internal blank voltage IVB1 and IVB2 may be determined by an average pixel voltage of the pixels of the display panel 100 corresponding to the input image in each frame.

For example, the first blank voltage VB1 may have a first polarity. The second blank voltage VB2 may have a second polarity opposite to the first polarity. Correspondingly, a first external blank voltage EVB1 may have the first polarity and a second external blank voltage EVB2 may have the second polarity. Correspondingly, a first internal blank voltage IVB1 may have the first polarity and a second internal blank voltage IVB2 may have the second polarity.

The blank voltage providing part 595 includes a blank digital to analog converting part BDAC1 and BDAC2, a blank buffering part BB1 and BB2 and a blank multiplexing part BMUX1 and BMUX2.

The blank digital to analog converting part BDAC1 and BDAC2 includes a first blank digital to analog convertor BDAC1 and a second blank digital to analog convertor BDAC2. The first blank digital to analog convertor BDAC1 converts the first internal blank voltage IVB1, which is a digital signal and is received from the power control part 580, into an analog signal. The second blank digital to analog convertor BDAC2 converts the second internal blank voltage IVB2, which is a digital signal and is received from the power control part 580, into an analog signal.

The blank buffering part BB1 and BB2 includes a first blank buffer BB1 and a second blank buffer BB2. The first blank buffer BB1 is coupled to the first blank digital to analog converter BDAC1 to buffer the first internal blank voltage IVB1, which is converted into the analog signal. The second blank buffer BB2 is coupled to the second blank digital to analog converter BDAC2 to buffer the second internal blank voltage IVB2, which is converted into the analog signal.

The blank multiplexing part BMUX1 and BMUX2 includes a first blank multiplexer BMUX1 and a second blank multiplexer BMUX2. The first blank multiplexer BMUX1 is coupled to a first external line, which applies the first external blank voltage EVB1 and the first blank buffer BB1 to selectively output one of the first external blank voltage EVB1 and the first internal blank voltage IVB1. The second blank multiplexer BMUX2 is coupled to a second external line, which applies the second external blank voltage EVB2 and the second blank buffer BB2 to selectively output one of the second external blank voltage EVB2 and the second internal blank voltage IVB2.

Figure 4A:
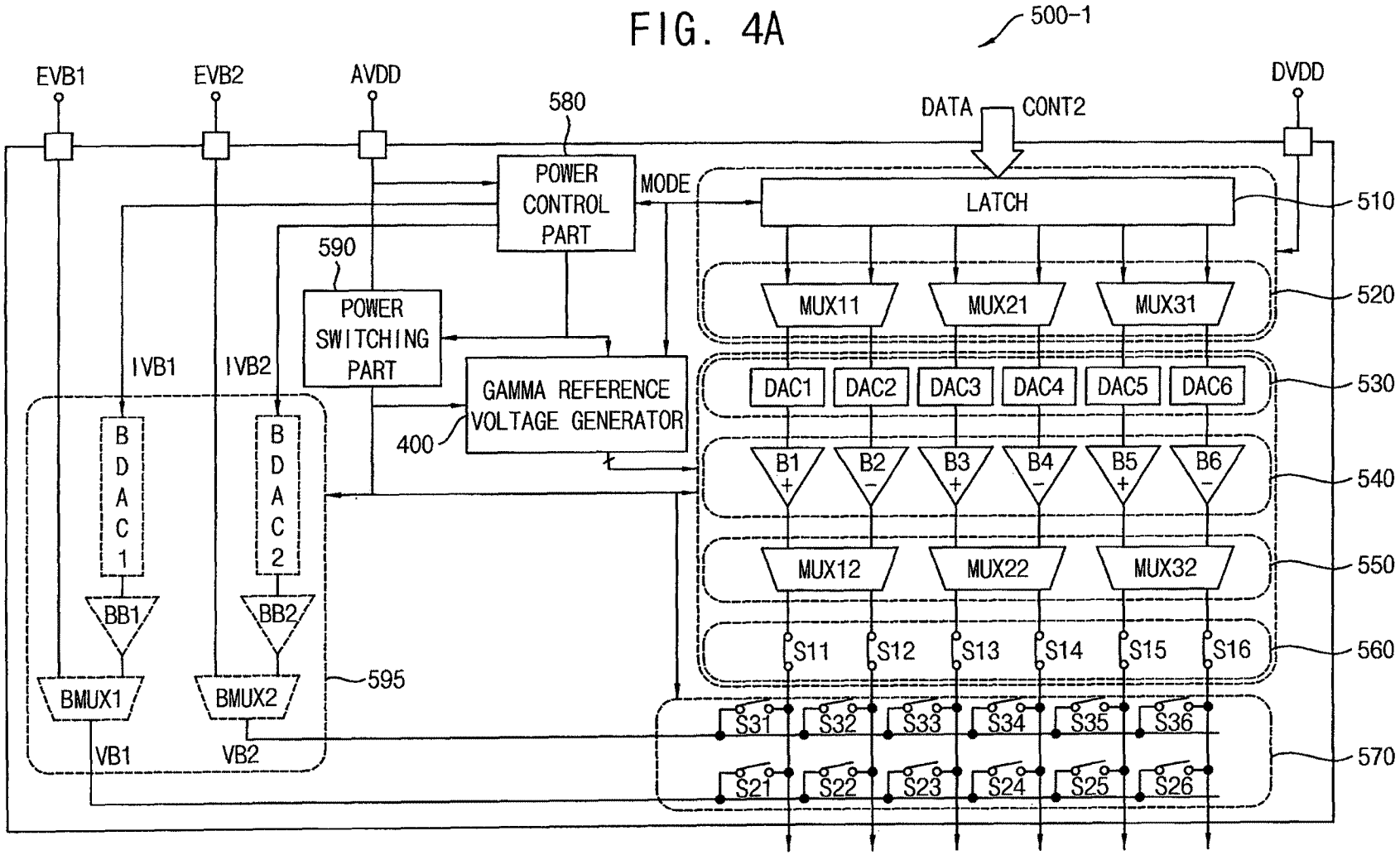
FIG. 4A is a block diagram illustrating the data driver of FIG. 1 in a normal mode, according to an example embodiment of the present invention.

FIG. 4A represents an operation of the data driver 500-1 in the normal mode, according to an example embodiment of the present invention. Referring again to FIG. 4A, in the normal mode, the latch part 510, the digital to analog converting part 530 and the buffer part 540 are turned on so that a normal data voltage, which is applied to the data line DL, is generated. In addition, in the normal mode, the first switching part 560 is turned on to apply the normal data voltage to the data line DL.

In one embodiment, in the normal mode, the blank voltage providing part 595 is turned off so that the blank voltages VB1 and VB2 are not generated. In addition, in the normal mode, all switches S21 to S26 and S31 to S36 of the second switching part 570 are turned off so that the data lines DL are not coupled to blank voltage applying lines.

Figure 4B:
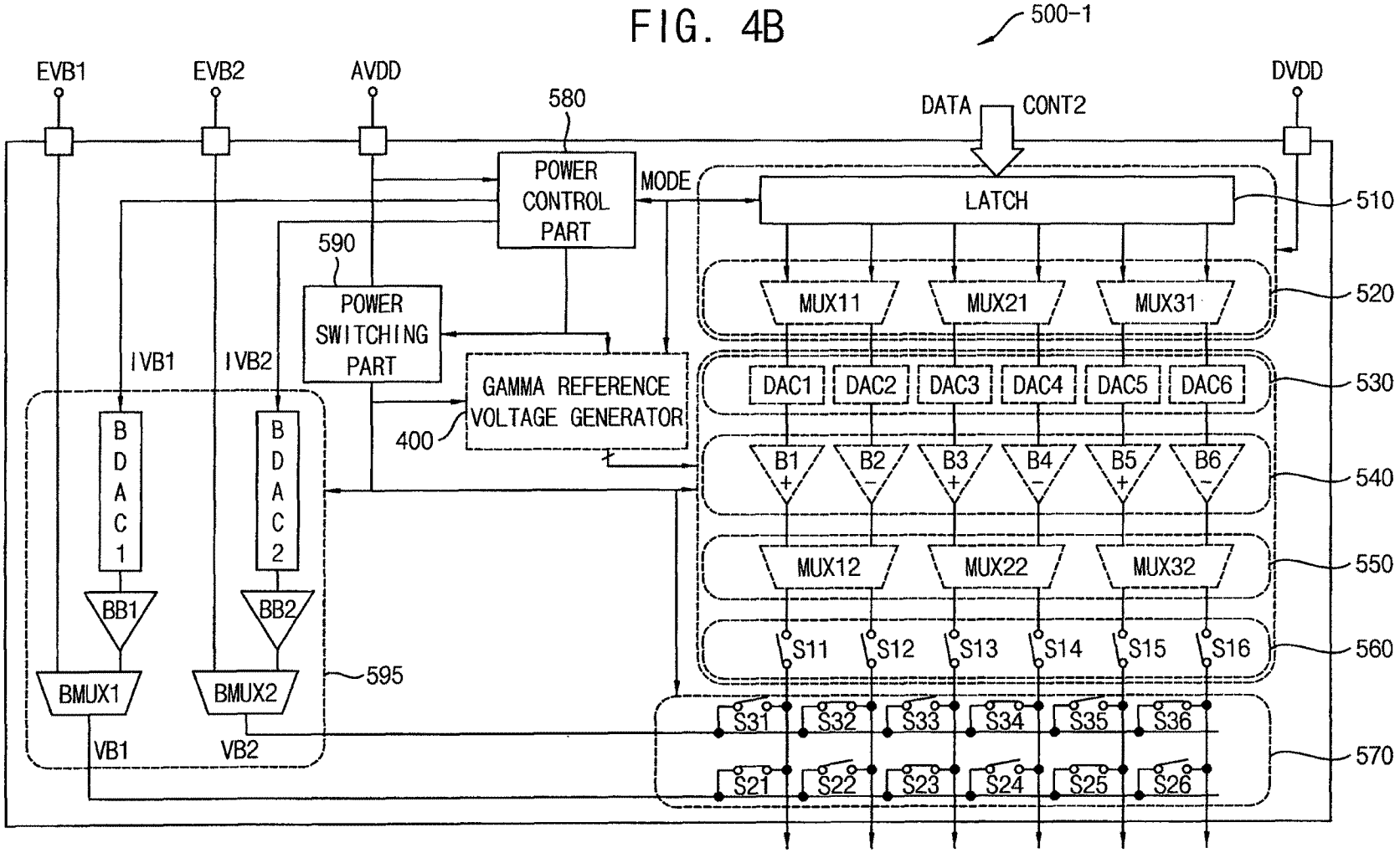
FIG. 4B is a block diagram illustrating the data driver of FIG. 1 during a blank period (e.g., a blank duration) in a low frequency mode, according to an example embodiment of the present invention.

FIG. 4B represents an operation of the data driver 500-1 in the blank period (e.g., the blank duration) of the low frequency mode, according to an example embodiment of the present invention. Referring again to FIG. 4B, in the blank period of the low frequency mode, the latch part 510, the digital to analog converting part 530 and the buffer part 540 are turned off so that the normal data voltage, which is applied to the data line DL, is not generated. In addition, in the blank period of the low frequency mode, the first switching part 560 is turned off so that the data lines DL are not coupled to the buffer part 540.

In one embodiment, in the blank period of the low frequency mode, the blank voltage providing part 595 is turned on so that the blank voltages VB1 and VB2 are provided to the second switching part 570. In addition, in the blank period of the low frequency mode, the second switching part 570 is turned on to apply the blank voltages VB1 and VB2 to the data lines DL.

According to the present example embodiment, the data driver 500-1 adjusts the frame rate FR according to the input image data RGB so that a power consumption of the display apparatus may be reduced. Further, the data driver 500-1 includes the power control part 580 controlling power according to the mode signal MODE, which is based on the input image data RGB so that a power consumption of the display apparatus may be further reduced. In addition, in the blank period of the low frequency mode, the blank voltages VB1 and VB2 having proper levels (e.g., suitable levels) are applied to the data line DL of the display panel 100 so that a leakage of the pixel current may be reduced (e.g., minimized). Thus, a display quality of the display panel 100 may be improved (e.g., increased).

Figure 5:
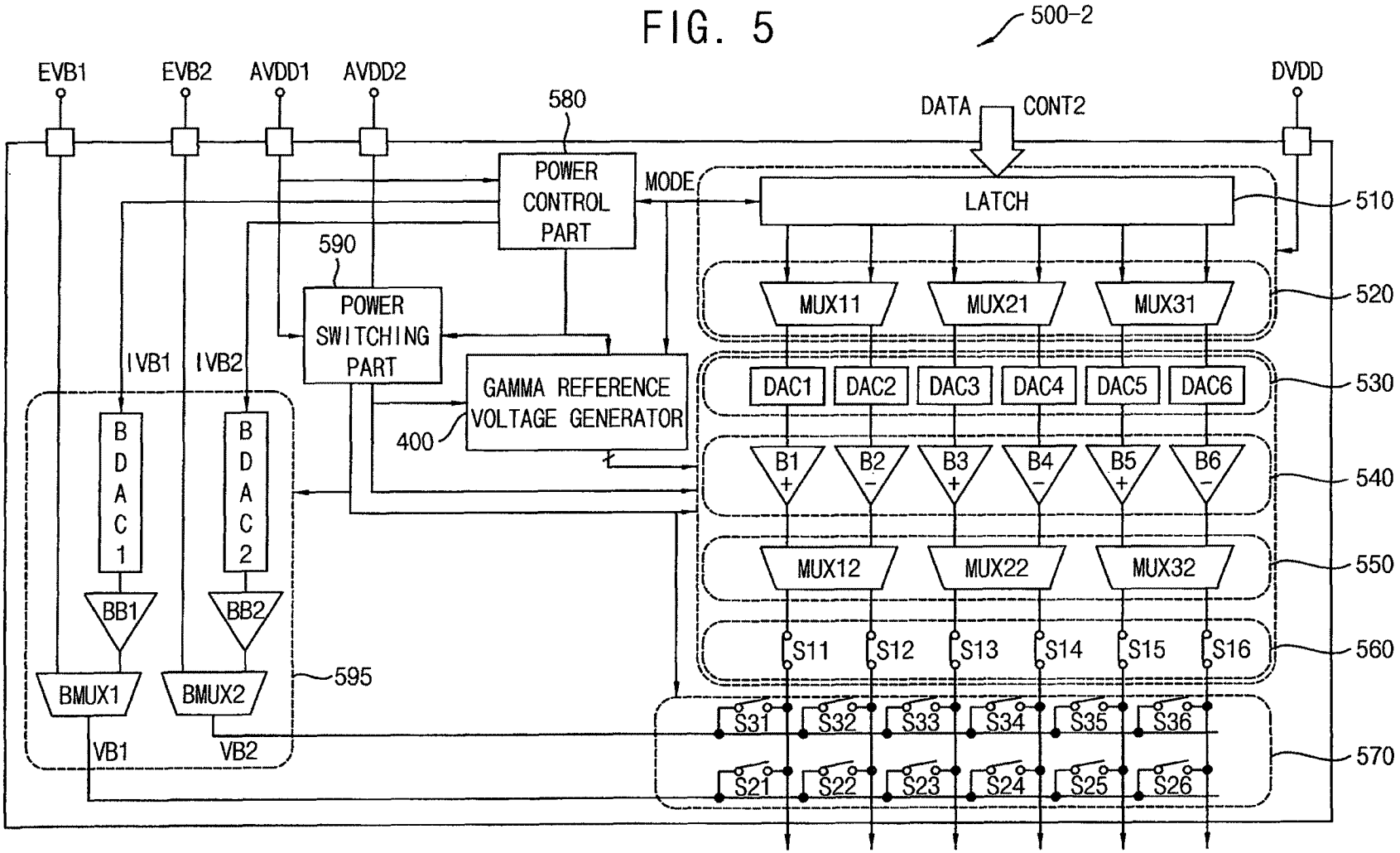
FIG. 5 is a block diagram illustrating a data driver, according to an example embodiment of the present invention.
Figure 6A:
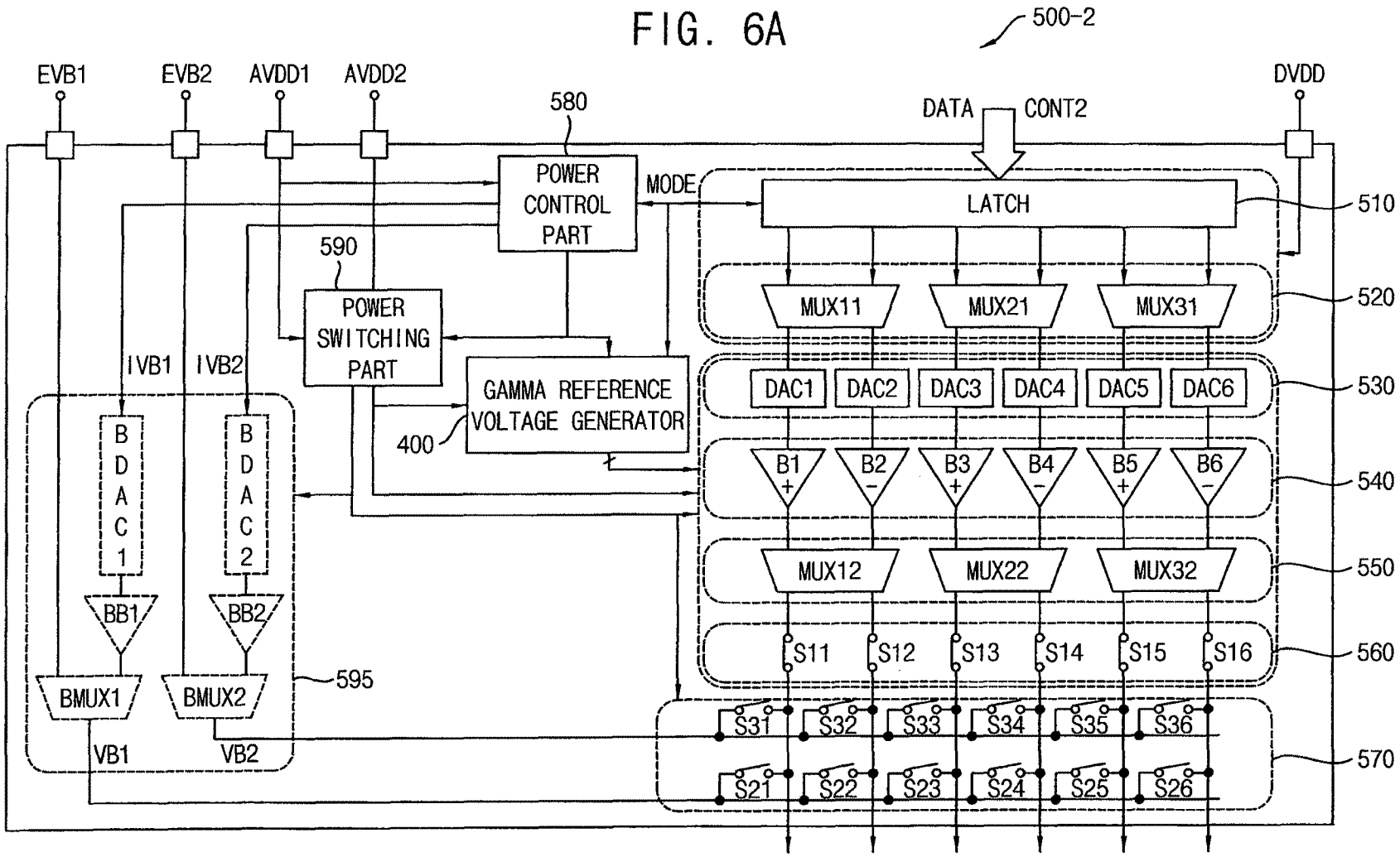
FIG. 6A is a block diagram illustrating the data driver of FIG. 5 in a normal mode, according to an example embodiment of the present invention.
Figure 6B:
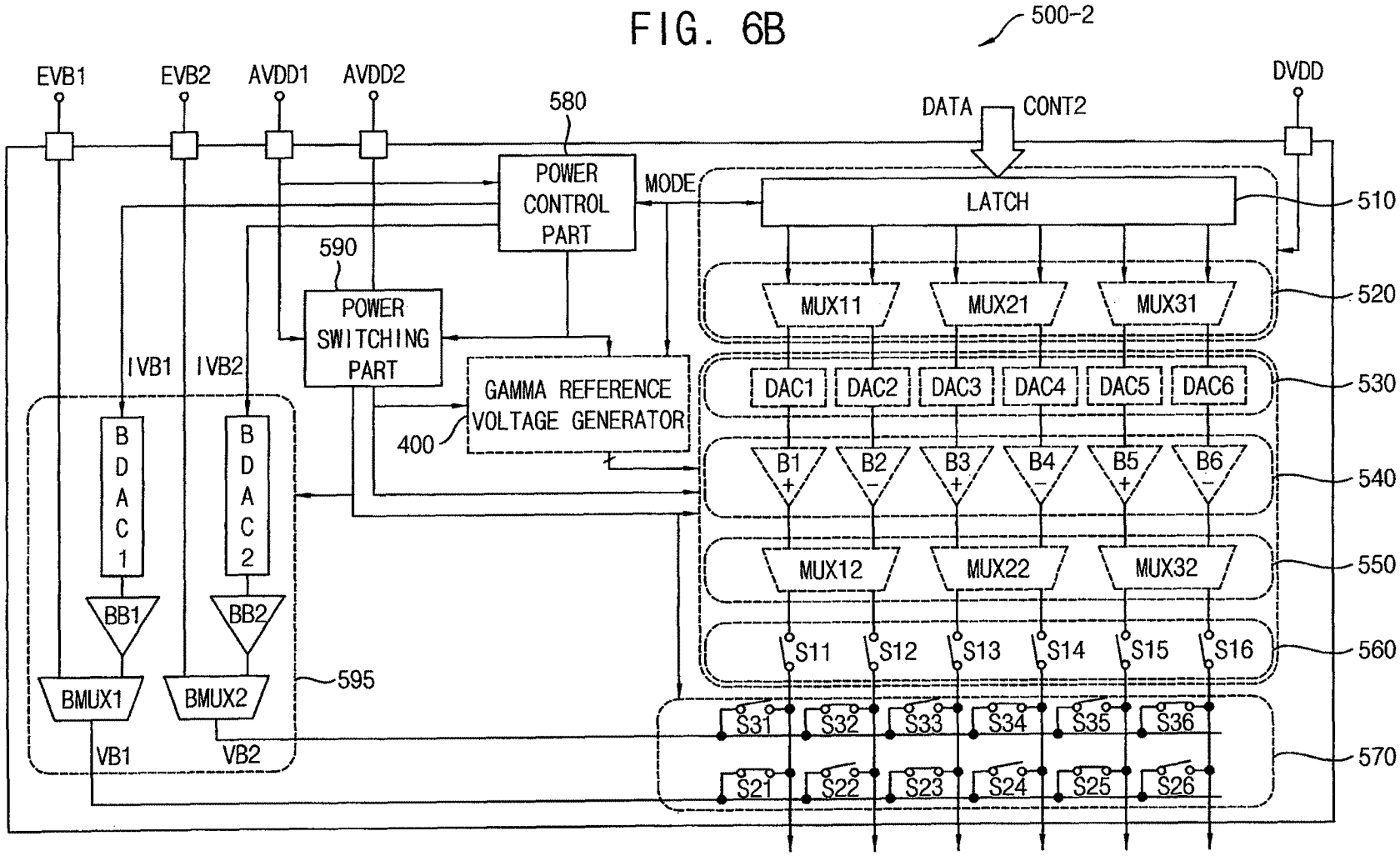
FIG. 6B is a block diagram illustrating the data driver of FIG. 5 during a blank period in a low frequency mode, according to an example embodiment of the present invention.

FIG. 5 is a block diagram illustrating a data driver 500-2, according to an example embodiment of the present invention. FIG. 6A is a block diagram illustrating the data driver 500-2 of FIG. 5 in a normal mode, according to an example embodiment of the present invention. FIG. 6B is a block diagram illustrating the data driver 500-2 of FIG. 5 during a blank period in a low frequency mode, according to an example embodiment of the present invention.

The data driver and the display apparatus according to the present example embodiment are substantially the same as the data driver and the display apparatus of the previous example embodiment described with reference to FIGS. 1 to 4B, except that first and second analog power voltage are applied to the power switching part 590. Thus, the same reference numerals will be used to refer to the same or like parts as those described in the previous example embodiment of FIGS. 1 to 4B and any repetitive explanation concerning the above elements will not be provided.

Referring to FIGS. 1, 2, 5, 6A, and 6B, the display apparatus includes a display panel 100 and a panel driver. The panel driver includes a timing controller 200, a gate driver 300, a gamma reference voltage generator 400, and a data driver 500/500-2.

The display panel 100 includes a plurality of gate lines GL, a plurality of data lines DL, and a plurality of pixels coupled to the gate lines GL and the data lines DL.

The timing controller 200 generates a first control signal CONT1, a second control signal CONT2, a third control signal CONT3, and a data signal DATA based on the input image data RGB and the input control signal CONT.

The timing controller 200 may adjust a frame rate FR of the display panel 100 based on the input image data RGB. The timing controller 200 may generate a mode signal MODE based on the input image data RGB. The mode signal MODE may include a normal mode and a low frequency mode.

The gate driver 300 generates gate signals driving the gate lines GL in response to the first control signal CONT1 received from the timing controller 200. The gate driver 300 sequentially outputs the gate signals to the gate lines GL.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500-2. The gamma reference voltage VGREF has a value corresponding to a level of the data signal DATA.

The data driver 500-2 receives the second control signal CONT2 and the data signal DATA from the timing controller 200, and receives the gamma reference voltages VGREF from the gamma reference voltage generator 400. The data driver 500-2 converts the data signal DATA into analog data voltages by utilizing (e.g., using) the gamma reference voltages VGREF. The data driver 500-2 outputs the data voltages to the data lines DL.

The data driver 500-2 includes a latch part 510, a first multiplexing part 520, a digital to analog converting part 530, a buffer part 540, a second multiplexing part 550, a first switching part 560, a second switching part 570, a power control part 580, a power switching part 590, and a blank voltage providing part 595.

The latch part 510 receives the data signal DATA. The latch part 510 temporally stores the data signal DATA and outputs the data signal DATA to the digital to analog converting part 530 through the first multiplexing part 520.

The digital to analog converting part 530 generates the analog data voltage based on the data signal DATA, which is a digital signal, and the gamma reference voltage VGREF. The digital to analog converting part 530 outputs the data voltage to the buffer part 540.

The buffer part 540 buffers the data voltage. The buffering part 540 compensates the data voltage to have a uniform level. The buffering part 540 outputs the compensated data voltage to the data line DL through the second multiplexing part 550, the first switching part 560, and the second switching part 570.

The first multiplexing part 520 and the second multiplexing part 550 operate as path selectors.

In the normal mode, the first switching part 560 is turned on to apply the data voltage to the data line DL.

In the blank period (e.g., the blank duration) of the low frequency mode, the second switching part 570 is turned on to apply a blank voltage to the data line DL.

The power control part 580 controls power of the data driver 500-2 according to the mode signal MODE, which is determined according to the input image. In the normal mode, the power control part 580 may turn on the first switching part 560 and may turn off the second switching part 570. In the blank period of the low frequency mode, the power control part 580 may turn off the first switching part 560 and may turn on the second switching part 570.

The power switching part 590 turns on or off elements in the data driver 500-2 according to control of the power control part 580.

In the blank period of the low frequency mode, the power switching part 590 may turn off the digital to analog converting part 530 and the buffer part 540. In the blank period of the low frequency mode, the power switching part 590 may turn off the gamma reference voltage generator 400, the first multiplexing part 520 and the second multiplexing part 550.

In the normal mode and in the normal output period of the low frequency mode, the power switching part 590 may turn off the blank voltage providing part 595.

In the present example embodiment, a first analog power voltage AVDD1 and a second analog power voltage AVDD2 are applied to the power switching part 590. The first analog power voltage AVDD1 may be a substantially constant voltage (e.g., a constant voltage). The second analog power voltage AVDD2 may be a variable voltage. The second analog power voltage AVDD2 may vary according to the mode signal MODE. For example, the second analog power voltage AVDD2 may have a relatively high level in the normal mode. In one embodiment, the second analog power voltage AVDD2 may have a relatively low level in the blank period of the low frequency mode. In the present example embodiment, a blank power control operation is operated out of the data driver 500-2. Accordingly, the second analog power voltage AVDD2 is provided to the data driver 500-2. Elements, which are always turned on among elements of the data driver 500-2, are driven by the first analog power voltage AVDD1.

The blank voltage providing part 595 provides the blank voltages VB1 and VB2 to the second switching part 570. In the blank period of the low frequency mode, the blank voltages VB1 and VB2 are applied to the data line DL through the second switching part 570.

According to the present example embodiment, the data driver 500-2 adjusts the frame rate FR according to the input image data RGB so that a power consumption of the display apparatus may be reduced. In addition, the data driver 500-2 includes the power control part 580 controlling power according to the mode signal MODE, which is based on the input image data RGB, so that a power consumption of the display apparatus may be further reduced. In addition, in the blank period of the low frequency mode, the blank voltages VB1 and VB2 having proper levels (e.g., suitable levels) are applied to the data line DL of the display panel 100 so that a leakage of the pixel current may be reduced (e.g., minimized). Thus, a display quality of the display panel 100 may be improved (e.g., increased).

Figure 7:
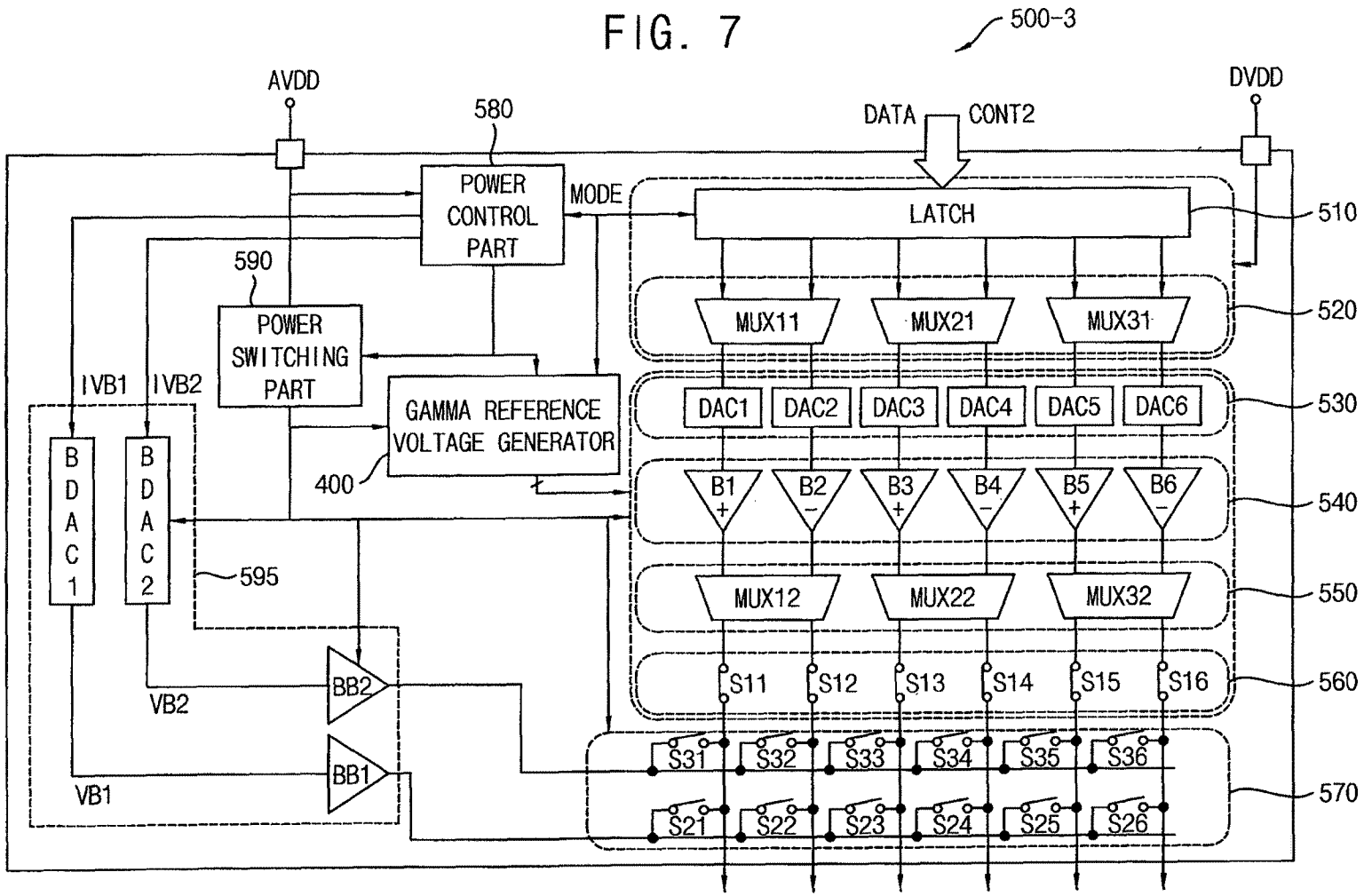
FIG. 7 is a block diagram illustrating a data driver, according to an example embodiment of the present invention.
Figure 8A:
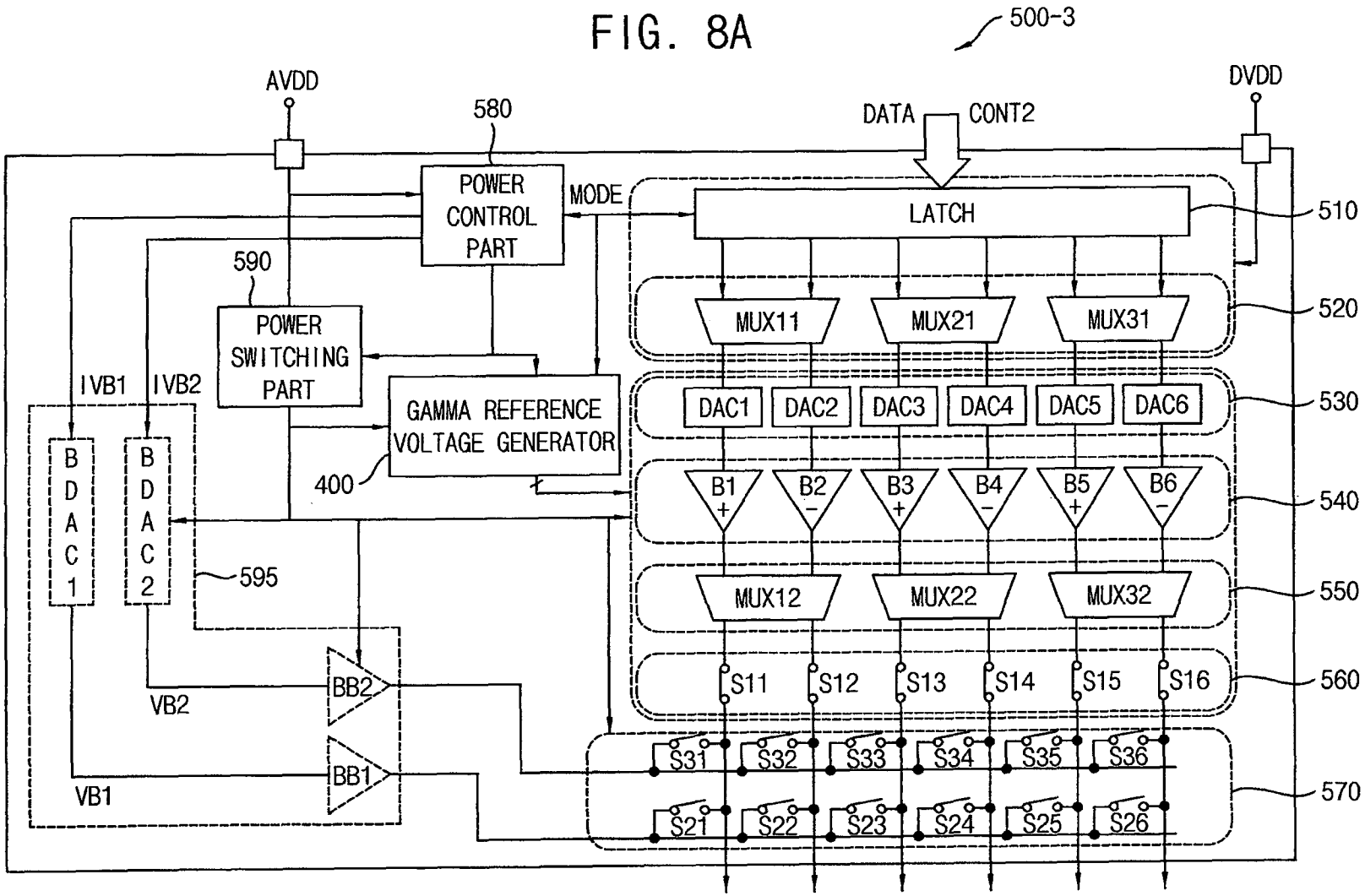
FIG. 8A is a block diagram illustrating the data driver of FIG. 7 in a normal mode, according to an example embodiment of the present invention.
Figure 8B:
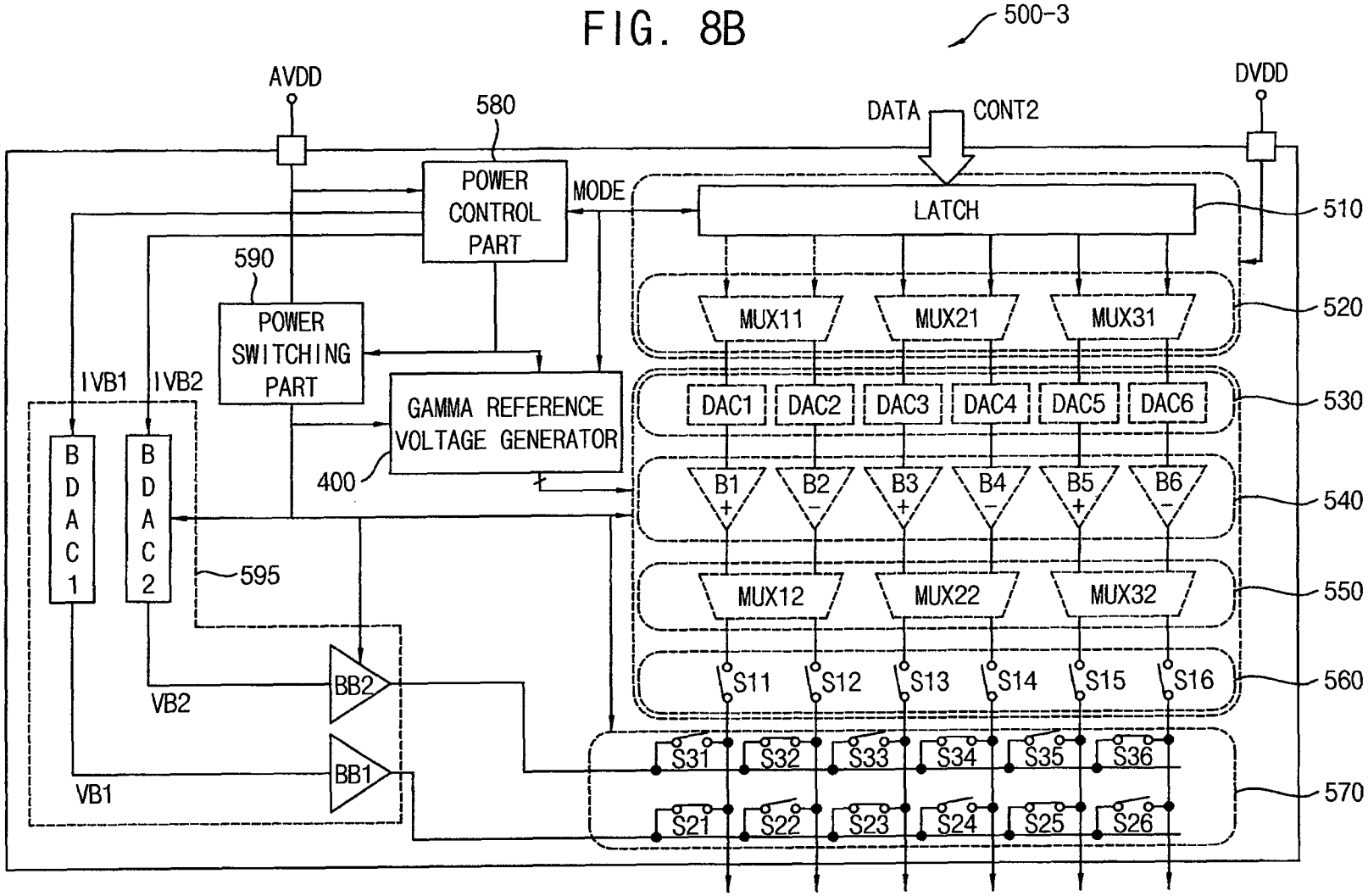
FIG. 8B is a block diagram illustrating the data driver of FIG. 7 during a blank period in a low frequency mode, according to an example embodiment of the present invention.

FIG. 7 is a block diagram illustrating a data driver 500-3 according to an example embodiment of the present invention. FIG. 8A is a block diagram illustrating the data driver 500-3 of FIG. 7 in a normal mode, according to an example embodiment of the present invention. FIG. 8B is a block diagram illustrating the data driver 500-3 of FIG. 7 during a blank period in a low frequency mode, according to an example embodiment of the present invention.

The data driver and the display apparatus, according to the present example embodiment, are substantially the same as the data driver and the display apparatus of the previous example embodiment described above with reference to FIGS. 1 to 4B, except that the blank voltages VB1 and VB2 are generated by the internal blank voltages IVB1 and IVB2. Thus, the same reference numerals will be used to refer to the same or like parts as those described in the previous example embodiment of FIGS. 1 to 4B and any repetitive explanation concerning the above elements will not be provided.

Referring to FIGS. 1, 2, 7, 8A, and 8B, the display apparatus includes a display panel 100 and a panel driver. The panel driver includes a timing controller 200, a gate driver 300, a gamma reference voltage generator 400 and a data driver 500-3.

The display panel 100 includes a plurality of gate lines GL, a plurality of data lines DL and a plurality of pixels coupled to the gate lines GL and the data lines DL.

The timing controller 200 generates a first control signal CONT1, a second control signal CONT2, a third control signal CONT3 and a data signal DATA based on the input image data RGB and the input control signal CONT.

The timing controller 200 may adjust a frame rate FR of the display panel 100, based on the input image data RGB. The timing controller 200 may generate a mode signal MODE based on the input image data RGB. The mode signal MODE may include a normal mode and a low frequency mode.

The gate driver 300 generates gate signals driving the gate lines GL in response to the first control signal CONT1 received from the timing controller 200. The gate driver 300 sequentially outputs the gate signals to the gate lines GL.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500-3. The gamma reference voltage VGREF has a value corresponding to a level of the data signal DATA.

The data driver 500-3 receives the second control signal CONT2 and the data signal DATA from the timing controller 200, and receives the gamma reference voltages VGREF from the gamma reference voltage generator 400. The data driver 500-3 converts the data signal DATA into analog data voltages by utilizing (e.g., using) the gamma reference voltages VGREF. The data driver 500-3 outputs the data voltages to the data lines DL.

The data driver 500-3 includes a latch part 510, a first multiplexing part 520, a digital to analog converting part 530, a buffer part 540, a second multiplexing part 550, a first switching part 560, a second switching part 570, a power control part 580, a power switching part 590 and a blank voltage providing part 595.

The latch part 510 receives the data signal DATA. The latch part 510 temporally stores the data signal DATA and outputs the data signal DATA to the digital to analog converting part 530 through the first multiplexing part 520.

The digital to analog converting part 530 generates the analog data voltage based on the data signal DATA, which is the digital signal and the gamma reference voltage VGREF. The digital to analog converting part 530 outputs the data voltage to the buffer part 540.

The buffer part 540 buffers the data voltage. The buffering part 540 compensates the data voltage to have a uniform level. The buffering part 540 outputs the compensated data voltage to the data line DL through the second multiplexing part 550, the first switching part 560, and the second switching part 570.

The first multiplexing part 520 and the second multiplexing part 550 operate as path selectors.

In the normal mode, the first switching part 560 is turned on to apply the data voltage to the data line DL.

In the blank period (e.g., the blank duration) of the low frequency mode, the second switching part 570 is turned on to apply a blank voltage to the data line DL.

The power control part 580 controls power of the data driver 500-3 according to the mode signal MODE, which is determined based on the input image. In the normal mode, the power control part 580 may turn on the first switching part 560 and may turn off the second switching part 570. In the blank period of the low frequency mode, the power control part 580 may turn off the first switching part 560 and may turn on the second switching part 570.

The power switching part 590 turns on or off elements in the data driver 500-3 according to control of the power control part 580.

In the blank period of the low frequency mode, the power switching part 590 may turn off the digital to analog converting part 530 and the buffer part 540. In the blank period of the low frequency mode, the power switching part 590 may turn off the gamma reference voltage generator 400, the first multiplexing part 520, and the second multiplexing part 550.

In the normal mode and in the normal output period of the low frequency mode, the power switching part 590 may turn off the blank voltage providing part 595.

The blank voltage providing part 595 provides the blank voltages VB1 and VB2 to the second switching part 570. In the blank period of the low frequency mode, the blank voltages VB1 and VB2 are applied to the data line DL through the second switching part 570.

In the present example embodiment, the blank voltages VB1 and VB2 are determined by the internal blank voltages IVB1 and IVB2 generated in the power control part 580.

The blank voltage VB1 and VB2 may be determined by utilizing (e.g., using) an average pixel voltage of pixels of the display panel 100. For example, the internal blank voltage IVB1 and IVB2 may vary in real time. The internal blank voltage IVB1 and IVB2 may be determined by an average pixel voltage of the pixels of the display panel 100 corresponding to the input image in each frame.

The blank voltage providing part 595 includes a blank digital to analog converting part BDAC1 and BDAC2 and a blank buffering part BB1 and BB2.

The blank digital to analog converting part BDAC1 and BDAC2 includes a first blank digital to analog convertor BDAC1 and a second blank digital to analog convertor BDAC2. The first blank digital to analog convertor BDAC1 converts the first internal blank voltage IVB1, which is a digital signal and is received from the power control part 580 into an analog signal. The second blank digital to analog convertor BDAC2 converts the second internal blank voltage IVB2, which is a digital signal and is received from the power control part 580, into an analog signal.

The blank buffering part BB1 and BB2 includes a first blank buffer BB1 and a second blank buffer BB2. The first blank buffer BB1 is coupled to the first blank digital to analog converter BDAC1 to buffer the first internal blank voltage IVB1, which is converted into the analog signal. The second blank buffer BB2 is coupled to the second blank digital to analog converter BDAC2 to buffer the second internal blank voltage IVB2, which is converted into the analog signal.

According to the present example embodiment, the data driver 500-3 adjusts the frame rate FR according to the input image data RGB so that a power consumption of the display apparatus may be reduced. In addition, the data driver 500-3 includes the power control part 580 controlling power according to the mode signal MODE according to the input image data RGB so that a power consumption of the display apparatus may be further reduced. In addition, in the blank period of the low frequency mode, the blank voltages VB1 and VB2 having proper levels (e.g., suitable levels) are applied to the data line DL of the display panel 100 so that a leakage of the pixel current may be reduced (e.g., minimized). Thus, a display quality of the display panel 100 may be improved (e.g., increased).

Figure 9:
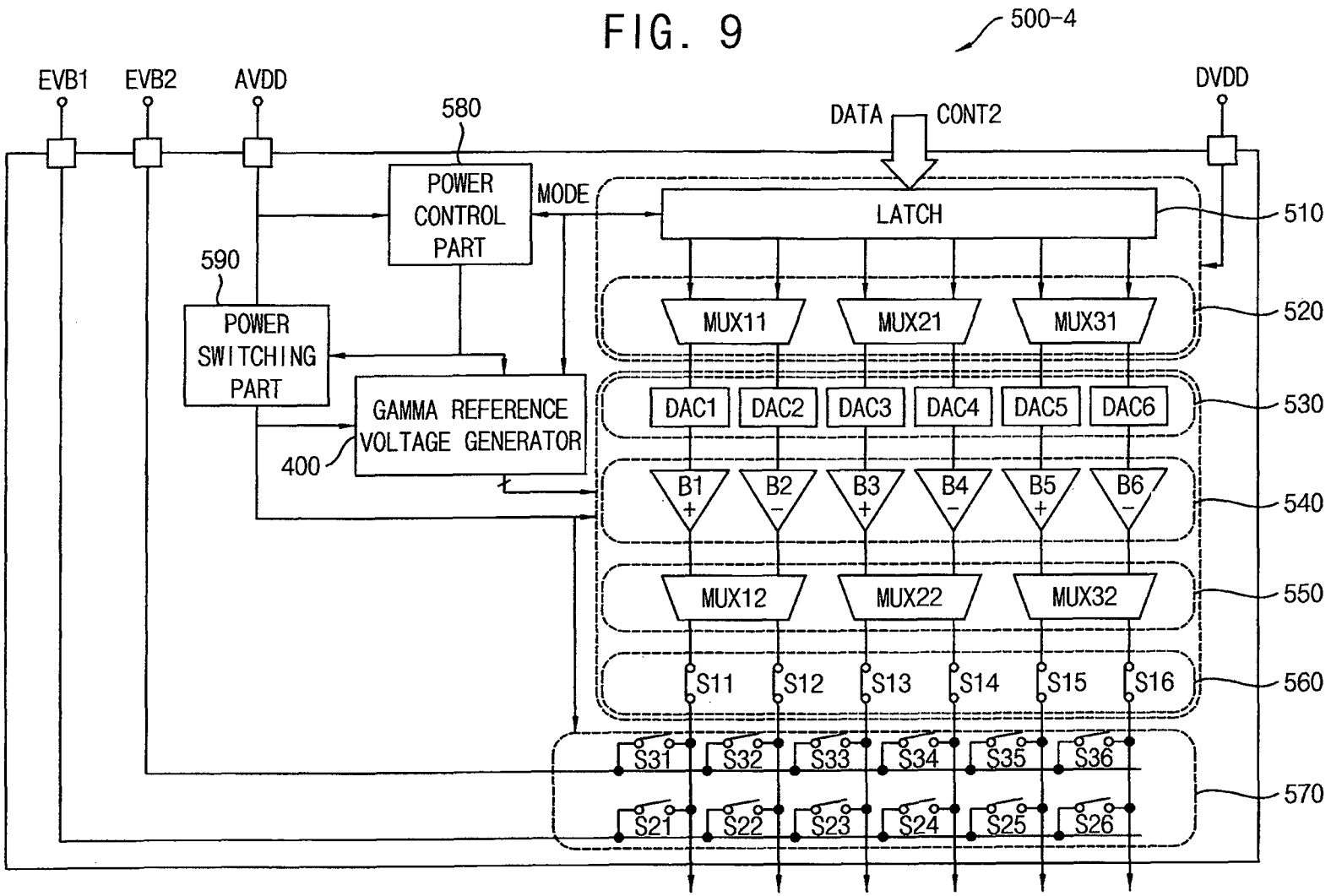
FIG. 9 is a block diagram illustrating a data driver, according to an example embodiment of the present invention.
Figure 10A:
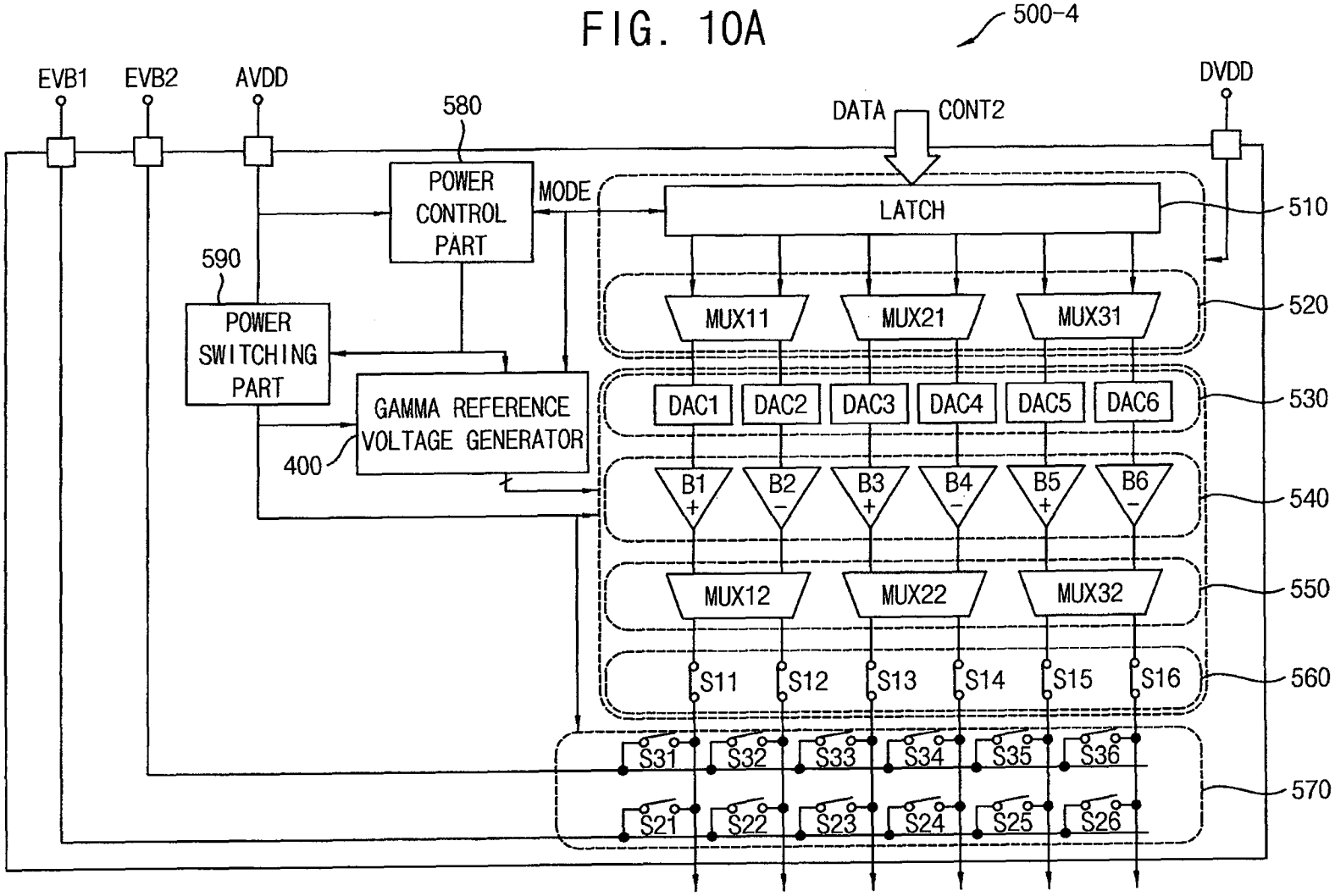
FIG. 10A is a block diagram illustrating the data driver of FIG. 9 in a normal mode, according to an example embodiment of the present invention.
Figure 10B:
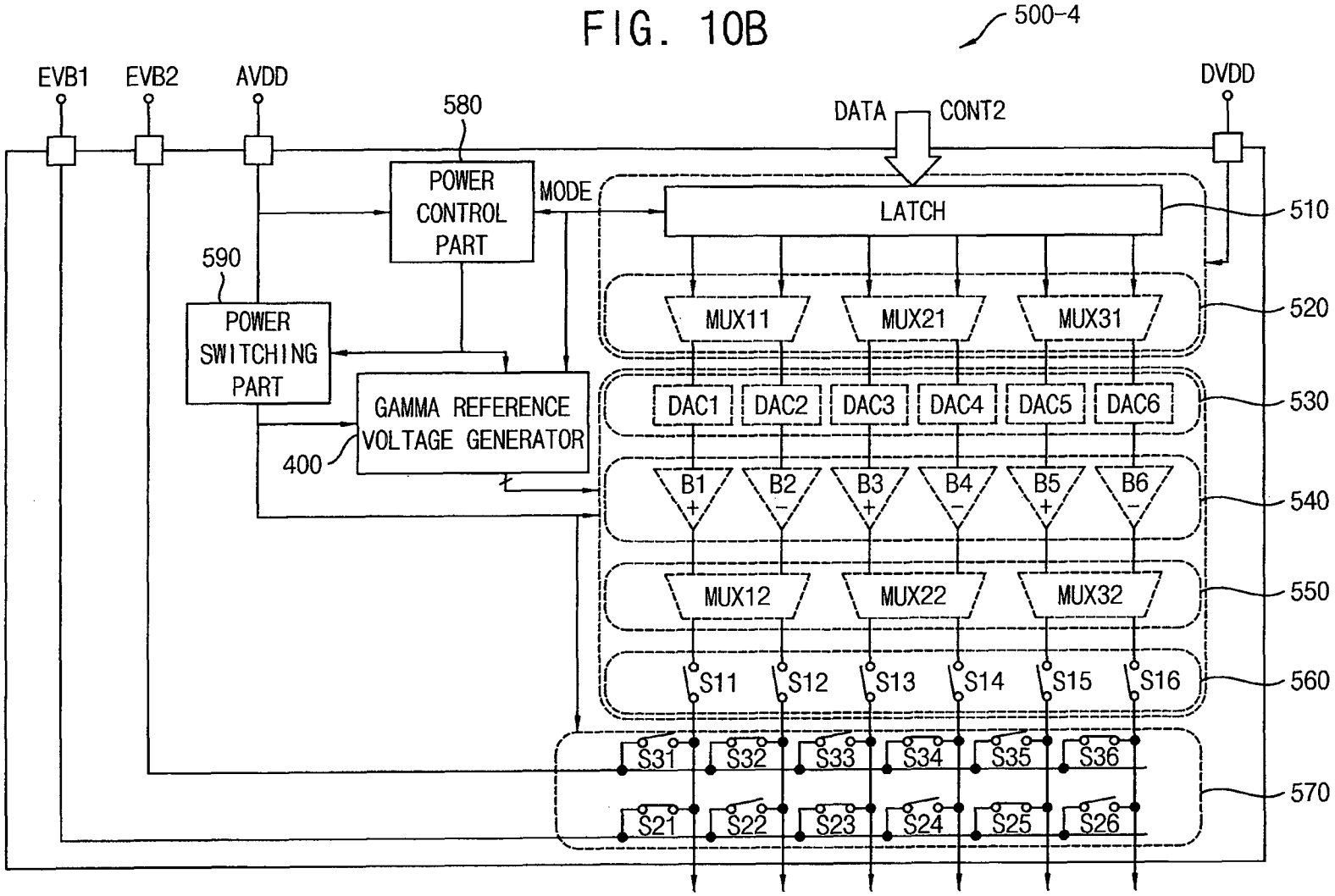
FIG. 10B is a block diagram illustrating the data driver of FIG. 9 during a blank period in a low frequency mode, according to an example embodiment of the present invention.

FIG. 9 is a block diagram illustrating a data driver 500-4, according to an example embodiment of the present invention. FIG. 10A is a block diagram illustrating the data driver 500-4 of FIG. 9 in a normal mode, according to an example embodiment of the present invention. FIG. 10B is a block diagram illustrating the data driver 500-4 of FIG. 9 during a blank period in a low frequency mode, according to an example embodiment of the present invention.

The data driver and the display apparatus according to the present example embodiment are substantially the same as the data driver and the display apparatus of the previous example embodiment described with reference to FIGS. 1 to 4B, except that the blank voltages VB1 and VB2 are generated by the external blank voltages EVB1 and EVB2. Thus, the same reference numerals will be used to refer to the same or like parts as those described in the previous example embodiment of FIGS. 1 to 4B and any repetitive explanation concerning the above elements will not be provided.

Referring to FIGS. 1, 2, 9, 10A and 10B, the display apparatus includes a display panel 100 and a panel driver. The panel driver includes a timing controller 200, a gate driver 300, a gamma reference voltage generator 400 and a data driver 500-4.

The display panel 100 includes a plurality of gate lines GL, a plurality of data lines DL and a plurality of pixels coupled to the gate lines GL and the data lines DL.

The timing controller 200 generates a first control signal CONT1, a second control signal CONT2, a third control signal CONT3, and a data signal DATA based on the input image data RGB and the input control signal CONT.

The timing controller 200 may adjust a frame rate FR of the display panel 100 based on the input image data RGB. The timing controller 200 may generate a mode signal MODE based on the input image data RGB. The mode signal MODE may include a normal mode and a low frequency mode.

The gate driver 300 generates gate signals driving the gate lines GL in response to the first control signal CONT1 received from the timing controller 200. The gate driver 300 sequentially outputs the gate signals to the gate lines GL.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500-4. The gamma reference voltage VGREF has a value corresponding to a level of the data signal DATA.

The data driver 500-4 receives the second control signal CONT2 and the data signal DATA from the timing controller 200, and receives the gamma reference voltages VGREF from the gamma reference voltage generator 400. The data driver 500-4 converts the data signal DATA into analog data voltages by utilizing (e.g., using) the gamma reference voltages VGREF. The data driver 500-4 outputs the data voltages to the data lines DL.

The data driver 500-4 includes a latch part 510, a first multiplexing part 520, a digital to analog converting part 530, a buffer part 540, a second multiplexing part 550, a first switching part 560, a second switching part 570, a power control part 580, and a power switching part 590.

The latch part 510 receives the data signal DATA. The latch part 510 temporally stores the data signal DATA and outputs the data signal DATA to the digital to analog converting part 530 through the first multiplexing part 520.

The digital to analog converting part 530 generates the analog data voltage based on the data signal DATA, which is a digital signal, and the gamma reference voltage VGREF. The digital to analog converting part 530 outputs the data voltage to the buffer part 540.

The buffer part 540 buffers the data voltage. The buffering part 540 compensates the data voltage to have a uniform level. The buffering part 540 outputs the compensated data voltage to the data line DL through the second multiplexing part 550, the first switching part 560, and the second switching part 570.

The first multiplexing part 520 and the second multiplexing part 550 operate as path selectors.

In the normal mode, the first switching part 560 is turned on to apply the data voltage to the data line DL.

In the blank period (e.g., the blank duration) of the low frequency mode, the second switching part 570 is turned on to apply a blank voltage to the data line DL.

The power control part 580 controls power of the data driver 500-4 according to the mode signal MODE, which is determined based on the input image. In the normal mode, the power control part 580 may turn on the first switching part 560 and may turn off the second switching part 570. In the blank period of the low frequency mode, the power control part 580 may turn off the first switching part 560 and may turn on the second switching part 570.

The power switching part 590 turns on or off elements in the data driver 500-4 according to control of the power control part 580.

In the blank period of the low frequency mode, the power switching part 590 may turn off the digital to analog converting part 530 and the buffer part 540. In the blank period of the low frequency mode, the power switching part 590 may turn off the gamma reference voltage generator 400, the first multiplexing part 520, and the second multiplexing part 550.

External lines provide the blank voltages EVB1 and EVB2 to the second switching part 570. In the blank period of the low frequency mode, the blank voltages EVB1 and EVB2 are applied to the data line DL through the second switching part 570.

In the present example embodiment, the blank voltages VB1 and VB2 are determined by the external blank voltages EVB1 and EVB2 provided from out of the data driver 500-4.

For example, the blank voltage EVB1 or EVB2 may not vary in real time. The blank voltage EVB1 or EVB2 may be determined (e.g., predetermined) by an average pixel voltage of the pixels of the display panel corresponding to a normal image. For example, the blank voltage EVB1 or EVB2 may represent a middle grayscale level.

According to the present example embodiment, the data driver 500-4 adjusts the frame rate FR according to the input image data RGB so that a power consumption of the display apparatus may be reduced. In addition, the data driver 500-4 includes the power control part 580 controlling power according to the mode signal MODE, which is based on the input image data RGB, so that a power consumption of the display apparatus may be further reduced. In addition, in the blank period of the low frequency mode, the blank voltages VB1 and VB2 having proper levels (e.g., suitable levels) are applied to the data line DL of the display panel 100 so that a leakage of the pixel current may be reduced (e.g., minimized). Thus, a display quality of the display panel 100 may be improved (e.g., increased).

Figure 11:
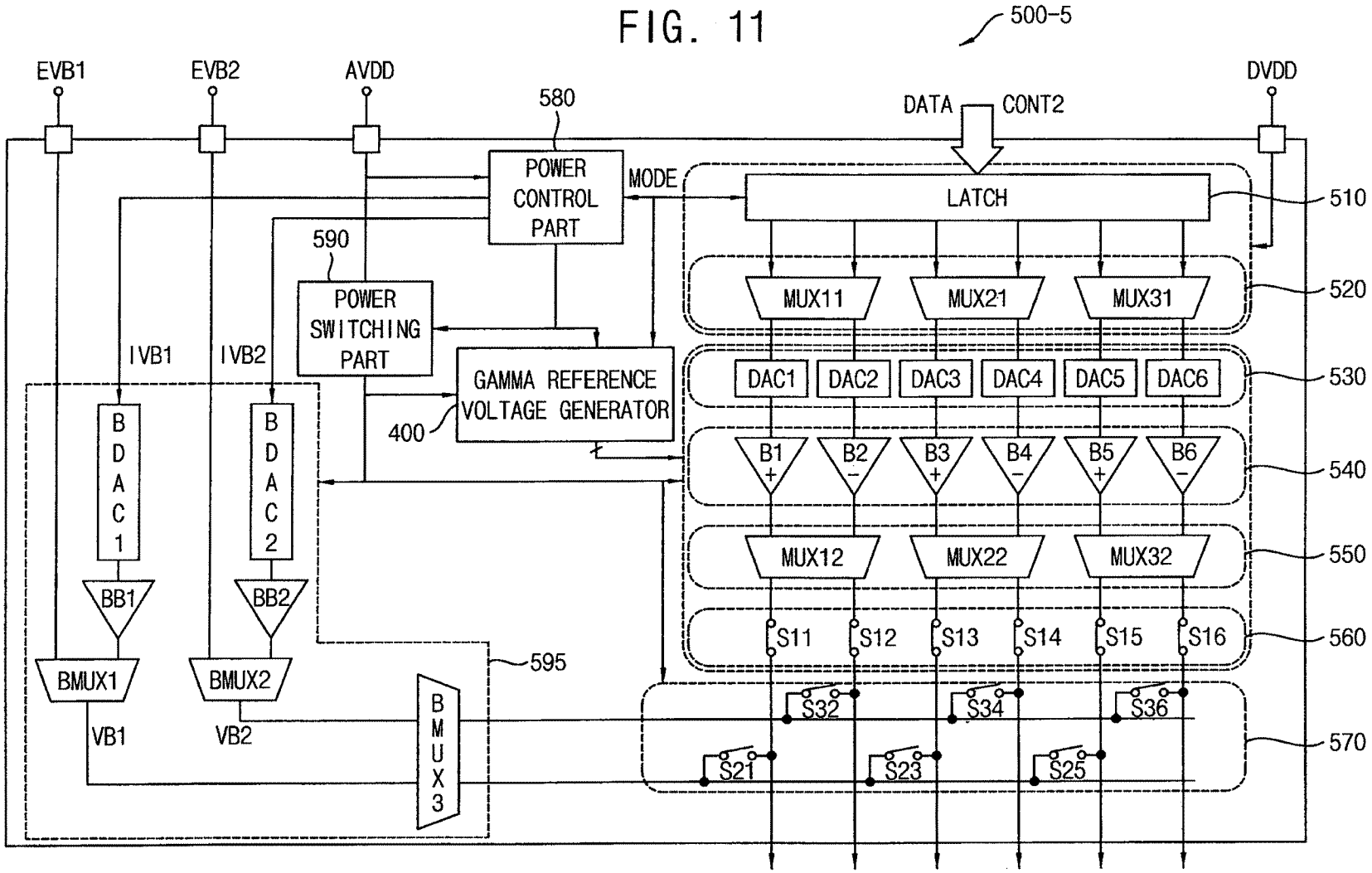
FIG. 11 is a block diagram illustrating a data driver, according to an example embodiment of the present invention.
Figure 12A:
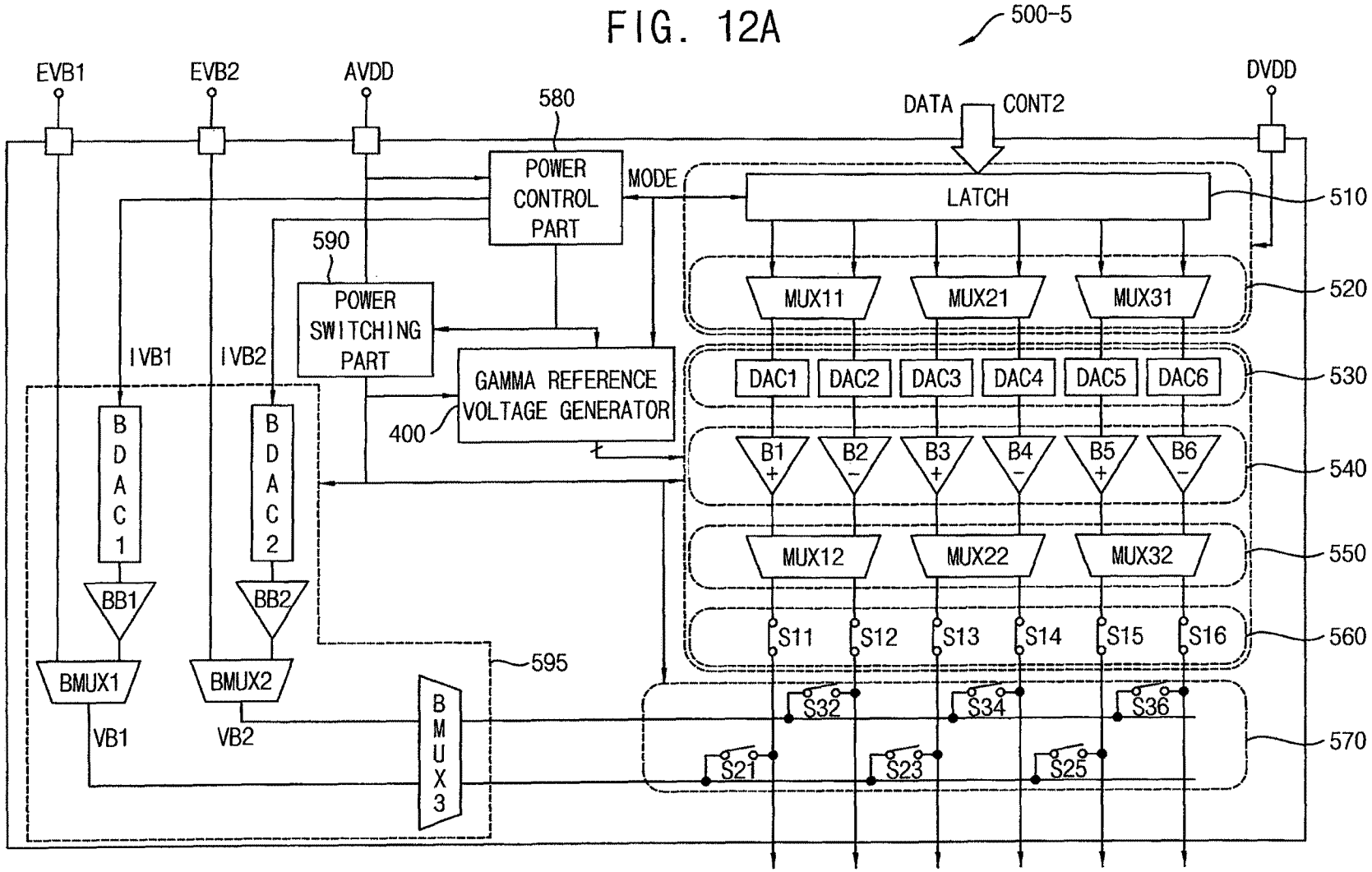
FIG. 12A is a block diagram illustrating the data driver of FIG. 11 in a normal mode, according to an example embodiment of the present invention.
Figure 12B:
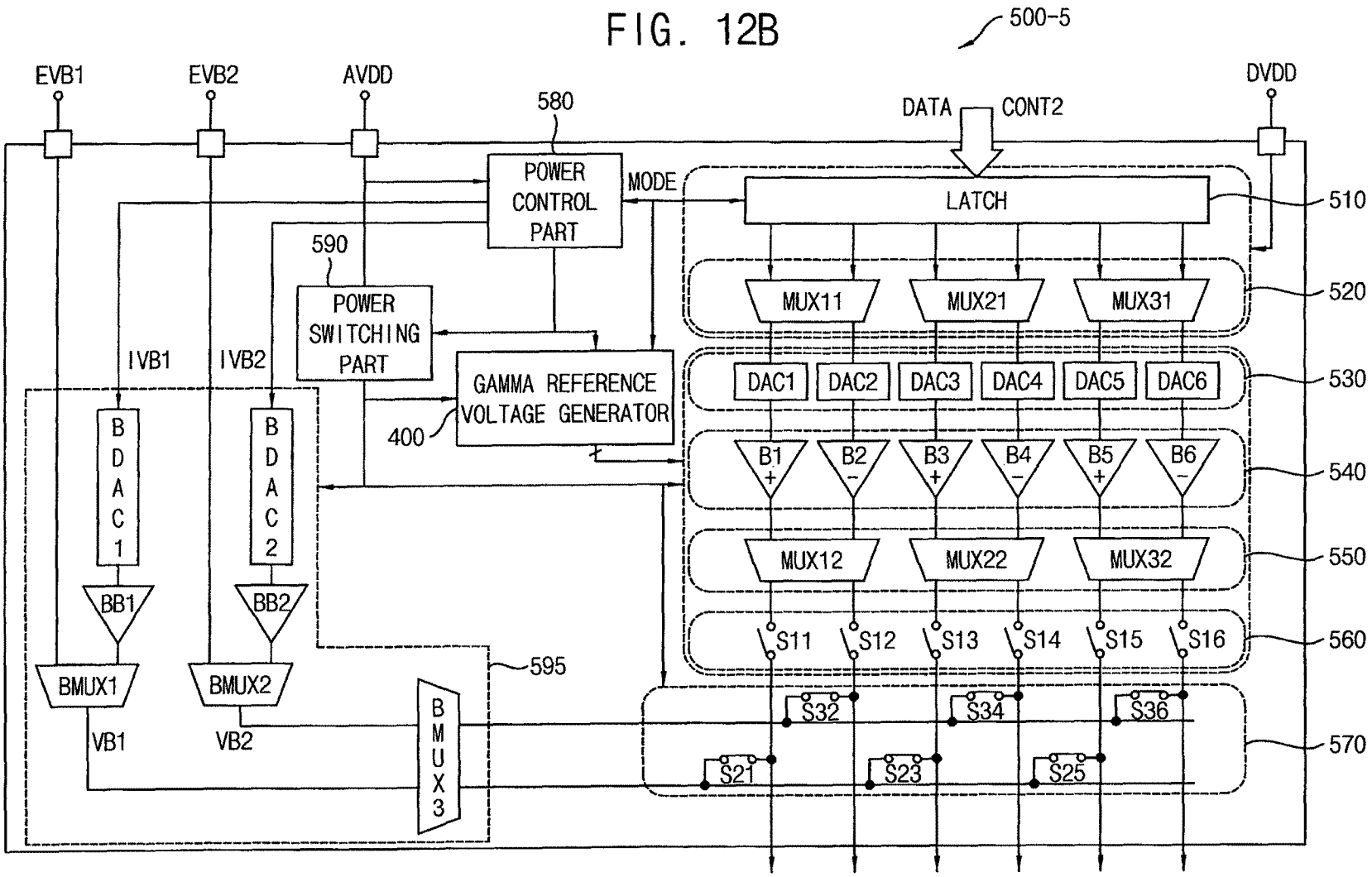
FIG. 12B is a block diagram illustrating the data driver of FIG. 11 during a blank period in a low frequency mode, according to an example embodiment of the present invention.

FIG. 11 is a block diagram illustrating a data driver 500-5 according to an example embodiment of the present invention. FIG. 12A is a block diagram illustrating the data driver 500-5 of FIG. 11 in a normal mode, according to an example embodiment of the present invention. FIG. 12B is a block diagram illustrating the data driver 500-5 of FIG. 11 during a blank period in a low frequency mode, according to an example embodiment of the present invention.

The data driver and the display apparatus according to the present example embodiment are substantially the same as the data driver and the display apparatus of the previous example embodiment described with reference to FIGS. 1 to 4B, except for the second switching part 570 and the blank voltage providing part 595. Thus, the same reference numerals will be used to refer to the same or like parts as those described in the previous example embodiment of FIGS. 1 to 4B and any repetitive explanation concerning the above elements will not be provided.

Referring to FIGS. 1, 2, 11, 12A and 12B, the display apparatus includes a display panel 100 and a panel driver. The panel driver includes a timing controller 200, a gate driver 300, a gamma reference voltage generator 400 and a data driver 500-5.

The display panel 100 includes a plurality of gate lines GL, a plurality of data lines DL and a plurality of pixels coupled to the gate lines GL and the data lines DL.

The timing controller 200 generates a first control signal CONT1, a second control signal CONT2, a third control signal CONT3, and a data signal DATA based on the input image data RGB and the input control signal CONT.

The timing controller 200 may adjust a frame rate FR of the display panel 100 based on the input image data RGB. The timing controller 200 may generate a mode signal MODE based on the input image data RGB. The mode signal MODE may include a normal mode and a low frequency mode.

The gate driver 300 generates gate signals driving the gate lines GL in response to the first control signal CONT1 received from the timing controller 200. The gate driver 300 sequentially outputs the gate signals to the gate lines GL.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500-5. The gamma reference voltage VGREF has a value corresponding to a level of the data signal DATA.

The data driver 500-5 receives the second control signal CONT2 and the data signal DATA from the timing controller 200, and receives the gamma reference voltages VGREF from the gamma reference voltage generator 400. The data driver 500 converts the data signal DATA into analog data voltages by utilizing (e.g., using) the gamma reference voltages VGREF. The data driver 500-5 outputs the data voltages to the data lines DL.

The data driver 500-5 includes a latch part 510, a first multiplexing part 520, a digital to analog converting part 530, a buffer part 540, a second multiplexing part 550, a first switching part 560, a second switching part 570, a power control part 580, a power switching part 590 and a blank voltage providing part 595.

The latch part 510 receives the data signal DATA. The latch part 510 temporally stores the data signal DATA and outputs the data signal DATA to the digital to analog converting part 530 through the first multiplexing part 520.

The digital to analog converting part 530 generates the analog data voltage based on the data signal DATA, which is a digital signal, and the gamma reference voltage VGREF. The digital to analog converting part 530 outputs the data voltage to the buffer part 540.

The buffer part 540 buffers the data voltage. The buffering part 540 compensates the data voltage to have a uniform level. The buffering part 540 outputs the compensated data voltage to the data line DL through the second multiplexing part 550, the first switching part 560, and the second switching part 570.

The first multiplexing part 520 and the second multiplexing part 550 operate as path selectors. For example, when the data voltages having the first polarity are outputted to odd-numbered data lines and the data voltages having the second polarity are outputted to even-numbered data lines during a first frame, a first multiplexer MUX11 of the first multiplexing part 520 and a second multiplexer MUX12 of the second multiplexing part 550 transmit a first data voltage of the first polarity to the first data line through the first digital to analog converter DAC1 and the first buffer B1 and transmit a second data voltage of the second polarity to the second data line through the second digital to analog converter DAC2 and the second buffer B2.

In one embodiment, when the data voltages having the second polarity are outputted to odd-numbered data lines and the data voltages having the first polarity are outputted to even-numbered data lines during a second frame, the first multiplexer MUX11 of the first multiplexing part 520 and the second multiplexer MUX12 of the second multiplexing part 550 transmit a second data voltage of the first polarity to the second data line through the first digital to analog converter DAC1 and the first buffer B1 and transmit a first data voltage of the second polarity to the first data line through the second digital to analog converter DAC2 and the second buffer B2.

In the normal mode, the first switching part 560 is turned on to apply the data voltage to the data line DL.

In the blank period of the low frequency mode, the second switching part 570 is turned on to apply a blank voltage to the data line DL.

In the present exemplary embodiment, the second switching part 570 includes switches S21, S23 and S25 in a first row and switches S32, S34 and S36 in a second row. The switches S21, S23 and S25 in the first row and the switches S32, S34 and S36 may be alternately disposed. For example, the switches S21, S23 and S25 in the first row may be coupled to odd numbered data lines. For example, the switches S32, S34 and S36 in the second row may be coupled to even numbered data lines. Alternatively, the switches S21, S23 and S25 in the first row may be coupled to even numbered data lines. The switches S32, S34 and S36 in the second row may be coupled to odd numbered data lines.

In the blank period of the low frequency mode, all of the switches S21, S23 and S25 in the first row and the switches S32, S34 and S36 may be turned on. In the blank period of the low frequency mode, a first switch S21 in the first row which is coupled to the first data line may be turned on, a first switch S32 in the second row which is coupled to the second data line may be turned on, a second switch S23 in the first row which is coupled to the third data line may be turned on, a second switch S34 in the second row which is coupled to the fourth data line may be turned on, a third switch S25 in the first row which is coupled to the fifth data line may be turned on, a third switch S36 in the second row which is coupled to the sixth data line may be turned on.

For example, during a first frame, the switches S21, S23 and S25 in the first row may apply the first blank voltage VB1 to the odd numbered data lines and the switches S32, S34 and S36 may apply the second blank voltage VB2 to the even numbered data lines. For example, during the first frame, all of the switches S21, S23 and S25 in the first row are turned on to apply the first blank voltage VB1 to the odd numbered data lines and all of the switches S32, S34 and S36 in the second row are turned on to apply the second blank voltage VB2 to the even numbered data lines.

The first blank voltage VB1 may have a polarity opposite to a polarity of the second blank voltage VB2. For example, the first blank voltage VB1 may have a positive polarity and the second blank voltage VB2 may have a negative polarity.

For example, during a second frame when polarities of the data voltages are inverted with respect to polarities of the data voltages in the first frame, the switches S21, S23 and S25 in the first row may apply the second blank voltage VB2 to the odd numbered data lines and the switches S32, S34 and S36 may apply the first blank voltage VB1 to the even numbered data lines. For example, during the second frame, all of the switches S21, S23 and S25 in the first row are turned on to apply the second blank voltage VB2 to the odd numbered data lines and all of the switches S32, S34 and S36 in the second row are turned on to apply the first blank voltage VB1 to the even numbered data lines.

The power control part 580 controls power of the data driver 500-5 according to the mode signal MODE which is determined according to the input image. In the normal mode, the power control part 580 may turn on the first switching part 560 and may turn off the second switching part 570. In the blank period of the low frequency mode, the power control part 580 may turn off the first switching part 560 and may turn on the second switching part 570.

The power control part 580 may control an operation of the power switching part according to the mode signal MODE. In addition, the power control part 580 may control an operation of the gamma reference voltage generator 400.

The power switching part 590 turns on or off elements in the data driver 500-5 according to control of the power control part 580.

In the blank period of the low frequency mode, the power switching part 590 may turn off the digital to analog converting part 530 and the buffer part 540. For example, in the blank period of the low frequency mode, the power switching part 590 may not provide a power voltage to the digital to analog converting part 530 and the buffer part 540. In the blank period of the low frequency mode, the power switching part 590 may turn off the gamma reference voltage generator 400, the first multiplexing part 520 and the second multiplexing part 550. For example, in the blank period of the low frequency mode, the power switching part 590 may not provide a power voltage to the gamma reference voltage generator 400, the first multiplexing part 520 and the second multiplexing part 550.

In the normal mode and in the normal output duration of the low frequency mode, the power switching part 590 may turn off the blank voltage providing part 595.

The blank voltage providing part 595 provides the blank voltages VB1 and VB2 to the second switching part 570. In the blank period of the low frequency mode, the blank voltages VB1 and VB2 are applied to the data line DL through the second switching part 570.

In the present example embodiment, the blank voltage VB1 and VB2 may be determined by one of an external blank voltage EVB1 and EVB2 applied from outside and internal blank voltage IVB1 and IVB2 generated in the power control part 580.

For example, the first blank voltage VB1 may have a first polarity. The second blank voltage VB2 may have a second polarity opposite to the first polarity. Correspondingly, a first external blank voltage EVB1 may have the first polarity and a second external blank voltage EVB2 may have the second polarity. Correspondingly, a first internal blank voltage IVB1 may have the first polarity and a second internal blank voltage IVB2 may have the second polarity.

In the present example embodiment, the blank voltage providing part 595 includes a blank digital to analog converting part BDAC1 and BDAC2, a blank buffering part BB1 and BB2, a blank multiplexing part BMUX1 and BMUX2 and a blank path selector BMUX3. For example, the blank path selector BMUX3 may be a multiplexer. Alternatively, the blank path selector BMUX3 may be a switch.

The blank digital to analog converting part BDAC1 and BDAC2 includes a first blank digital to analog convertor BDAC1 and a second blank digital to analog convertor BDAC2. The first blank digital to analog convertor BDAC1 converts the first internal blank voltage IVB1 which is a digital signal and is received from the power control part 580 into an analog signal. The second blank digital to analog convertor BDAC2 converts the second internal blank voltage IVB2 which is a digital signal and is received from the power control part 580, into an analog signal.

The blank buffering part BB1 and BB2 includes a first blank buffer BB1 and a second blank buffer BB2. The first blank buffer BB1 is coupled to the first blank digital to analog converter BDAC1 to buffer the first internal blank voltage IVB1 which is converted into the analog signal. The second blank buffer BB2 is coupled to the second blank digital to analog converter BDAC2 to buffer the second internal blank voltage IVB2 which is converted into the analog type.

The blank multiplexing part BMUX1 and BMUX2 includes a first blank multiplexer BMUX1 and a second blank multiplexer BMUX2. The first blank multiplexer BMUX1 is coupled to a first external line which applies the first external blank voltage EVB1 and the first blank buffer BB1 to selectively output one of the first external blank voltage EVB1 and the first internal blank voltage IVB1. The second blank multiplexer BMUX2 is coupled to a second external line which applies the second external blank voltage EVB2 and the second blank buffer BB2 to selectively output one of the second external blank voltage EVB2 and the second internal blank voltage IVB2.

The blank path selector BMUX3 coupled to the second switching part 270 changes a path of transmitting the first blank voltage VB1 and the second blank voltage VB2 in every frame. For example, during the first frame, the blank path selector BMUX3 transmits the first blank voltage VB1 to the switches S21, S23 and S25 in the first row and the second blank voltage VB2 to the switches S32, S34 and S36 in the second row. In contrast, during the second frame, the blank path selector BMUX3 transmits the second blank voltage VB2 to the switches S21, S23 and S25 in the first row and the first blank voltage VB1 to the switches S32, S34 and S36 in the second row.

Although the blank path selector BMUX3 is coupled to the blank multiplexing part BMUX1 and BMUX (in FIGS. 3 and 5) in the present exemplary embodiment, the blank path selector BMUX3 may be applied to exemplary embodiments explained referring to FIGS. 7 and 9. For example, the blank path selector BMUX3 may be coupled to the blank buffering part BB1 and BB2 in FIG. 7. For example, the blank path selector BMUX3 may be coupled to the external lines in FIG. 9 providing the blank voltages EVB1 and EVB2 to the second switching part 570.

According to the present example embodiment, the data driver 500-5 adjusts the frame rate FR according to the input image data RGB so that a power consumption of the display apparatus may be reduced. In addition, the data driver 500-5 includes the power control part 580 controlling power according to the mode signal MODE according to the input image data RGB so that a power consumption of the display apparatus may be further reduced. In addition, in the blank period of the low frequency mode, the blank voltages VB1 and VB2 having proper levels (e.g., suitable levels) are applied to the data line DL of the display panel 100 so that a leakage of the pixel current may be reduced (e.g., minimized). Thus, a display quality of the display panel 100 may be improved (e.g., increased).

In addition, the blank path selector BMUX3 switches the first blank voltage VB1 and the second blank voltage VB2 and outputs the first blank voltage VB1 and the second blank voltage VB2 to the second switching part 570 so that the number of the switches of the second switching part 570 may decrease.

According to the present example embodiment, a power consumption of the display apparatus may be reduced and a display quality of the display panel may be improved (e.g., increased).

The foregoing is illustrative of the present invention and is not to be construed as limiting thereof. Although a few example embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific example embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A data driver comprising:

a power control part configured to control power according to mode signal determined based on an input image;

a digital to analog converting part configured to convert a digital data signal into an analog data voltage;

a buffering part configured to buffer the data voltage;

a first switching part configured to apply the data voltage to a data line in a normal mode, when turned on;

a second switching part configured to apply a blank voltage to the data line in a blank period of a low frequency mode, when turned on; and a blank voltage providing part configured to provide the blank voltage to the second switching part, wherein the blank voltage is determined by one of an external blank voltage applied from out of the data driver and an internal blank voltage generated in the power control part, and wherein the blank voltage providing part comprises:

a blank digital to analog converter coupled to the power control part;

a blank buffer coupled to the blank digital to analog converter; and a blank multiplexer coupled to an external line and the blank buffer, and configured to selectively output the external blank voltage or the internal blank voltage.

2. The data driver of claim 1, further comprising a power switching part configured to turn off the digital to analog converting part and the buffering part in the blank period of a low frequency mode.

3. The data driver of claim 2, wherein the power switching part is configured to receive a first power voltage that is a substantially constant voltage, and a second power voltage that is a variable voltage.

4. The data driver of claim 1, wherein the power control part is further configured to activate and deactivate the second switching part.

5. The data driver of claim 1, wherein the blank voltage is determined by an internal blank voltage generated in the power control part.

6. The data driver of claim 5, wherein the blank voltage providing part comprises:

a blank digital to analog converter coupled to the power control part; and a blank buffer coupled to the blank digital to analog converter.

7. The data driver of claim 1, wherein the blank voltage is determined by an external blank voltage applied from outside of the data driver.

8. The data driver of claim 1, wherein the blank voltage is determined by utilizing an average pixel voltage of pixels of a display panel corresponding to the input image.

9. The data driver of claim 1, wherein the second switching part comprises:

switches in a first row configured to be alternately turned on to apply a first blank voltage to the data line; and switches in a second row configured to be alternately turned on to apply a second blank voltage to the data line.

10. The data driver of claim 9, wherein the first blank voltage has a polarity opposite to that of the second blank voltage.

11. The data driver of claim 1, wherein the second switching part comprises:

switches in a first row coupled to odd-numbered data lines; and switches in a second row coupled to even-numbered data lines.

12. The data driver of claim 11, further comprising a blank path selector configured to alternately transmit a first blank voltage and a second blank voltage to the switches in the first row and to alternately transmit the second blank voltage and the first blank voltage to the switches in the second row.

13. A display apparatus comprising:

a display panel configured to display an image based on an input image;

a timing controller configured to generate a frame rate of the display panel and a mode signal based on the input image; and a data driver comprising:

a power control part configured to control power according to the mode signal;

a digital to analog converting part configured to convert a digital data signal into an analog data voltage;

a buffering part configured to buffer the data voltage;

a first switching part configured to apply the data voltage to a data line in a normal mode, when turned on;

a second switching part configured to apply a blank voltage to the data line in a blank period of a low frequency mode, when turned on; and a blank voltage providing part configured to provide the blank voltage to the second switching part, wherein the power control part is further configured to activate and deactivate the second switching part, wherein the blank voltage is determined by one of an external blank voltage applied from out of the data driver and an internal blank voltage generated in the power control part, and wherein the blank voltage providing part comprises:

a blank digital to analog converter coupled to the power control part;

a blank buffer coupled to the blank digital to analog converter; and a blank multiplexer coupled to an external line and the blank buffer, and configured to selectively output the external blank voltage or the internal blank voltage.

14. The display apparatus of claim 13, wherein the data driver further comprises a power switching part configured to turn off the digital to analog converting part and the buffering part in the blank period of a low frequency mode.

15. The display apparatus of claim 13, wherein the blank voltage is determined by utilizing an average pixel voltage of pixels of a display panel corresponding to the input image.

* * * * *